US012458841B2

(12) United States Patent
Kim

(10) Patent No.: US 12,458,841 B2
(45) Date of Patent: Nov. 4, 2025

(54) EXERCISE METHOD AND DEVICE

(71) Applicant: Eun Bee Kim, Chuncheonsi (KR)

(72) Inventor: Eun Bee Kim, Chuncheonsi (KR)

( * ) Notice: Subject to any disclaimer, the term of this patent is extended or adjusted under 35 U.S.C. 154(b) by 0 days.

(21) Appl. No.: 18/213,280

(22) Filed: Jun. 23, 2023

(65) Prior Publication Data

US 2023/0330482 A1 Oct. 19, 2023

Related U.S. Application Data

(62) Division of application No. 17/928,325, filed as application No. PCT/KR2021/006706 on May 29, 2021, now abandoned.

(30) Foreign Application Priority Data

| | | |
|---|---|---|
| Jun. 1, 2020 | (KR) | 20-2020-0001877 |
| Sep. 22, 2020 | (KR) | 10-2020-0122326 |
| Nov. 15, 2020 | (KR) | 10-2020-0152414 |
| Nov. 17, 2020 | (KR) | 10-2020-0153238 |
| Nov. 29, 2020 | (KR) | 10-2020-0163490 |
| Dec. 9, 2020 | (KR) | 10-2020-0170941 |
| Dec. 19, 2020 | (KR) | 10-2020-0179121 |
| Jan. 10, 2021 | (KR) | 10-2021-0002955 |
| Mar. 4, 2021 | (KR) | 10-2021-0029110 |
| Mar. 18, 2021 | (KR) | 10-2021-0035113 |
| Mar. 29, 2021 | (KR) | 10-2021-0040066 |

(Continued)

(51) Int. Cl.

| | |
|---|---|
| ***A63B 23/04*** | (2006.01) |
| ***A63B 21/00*** | (2006.01) |
| ***A63B 23/035*** | (2006.01) |

(52) U.S. Cl.
CPC ..... *A63B 23/0405* (2013.01); *A63B 21/154* (2013.01); *A63B 21/4034* (2015.10);
(Continued)

(58) Field of Classification Search
CPC ..... A63B 23/0405; A63B 21/154; A63B 21/4034; A63B 21/4045; A63B 21/4047;
(Continued)

(56) References Cited

U.S. PATENT DOCUMENTS 4,556,216 A * 12/1985 Pitkanen ..... A63B 23/0355 482/901
4,720,099 A * 1/1988 Carlson ..... A63B 21/0052 482/901

(Continued)

*Primary Examiner* — Joshua Lee
*Assistant Examiner* — Catrina A Letterman

(57) ABSTRACT

Embodiments of the present invention provide an exercise device including a front vertical post is aligned along a virtual horizontal centerline d of the seat; a guiding rail, wherein the guiding rail extends from a top to a bottom in a curved shape; a pivot point on a coronal plane of the guiding rail; a slide arm, wherein the slide arm is slidably connected to the guiding rail and extends horizontally from a left or right side of the guiding rail and configured to slide up and down along the guiding rail, wherein, in a first configuration, a longitudinal axis of the sliding arm is disposed parallel to the ground; and in a second configuration, longitudinal axis of the sliding arm is disposed perpendicularly to the ground.

1 Claim, 35 Drawing Sheets

(30) Foreign Application Priority Data

Apr. 5, 2021 (KR) ..... 10-2021-0044071
Apr. 8, 2021 (KR) ..... 10-2021-0046163
Apr. 9, 2021 (KR) ..... 10-2021-0046813
May 6, 2021 (KR) ..... 10-2021-0058860

(52) U.S. Cl.
CPC ..... *A63B 21/4045* (2015.10); *A63B 21/4047* (2015.10); *A63B 23/03533* (2013.01); *A63B 2208/0233* (2013.01); *A63B 2208/0242* (2013.01)

(58) Field of Classification Search
CPC ..... A63B 23/03533; A63B 2208/0233; A63B 2208/0242; A63B 23/0476; A63B 23/0482; A63B 23/0494; A63B 2220/16; A63B 2220/17; A63B 2225/50; A63B 22/06; A63B 23/04; A63B 17/00; A63B 17/02; A63B 2022/0028; A63B 2022/003; A63B 2022/0071; A63B 2022/0074; A63B 2023/0441; A63B 2023/0447; A63B 2023/0452; A63B 21/00047; A63B 21/15; A63B 21/22; A63B 21/4023; A63B 21/4027; A63B 21/4029; A63B 21/4049; A63B 22/0015; A63B 22/0017; A63B 22/0025; A63B 22/0046; A63B 22/0048; A63B 22/0056; A63B 22/0058; A63B 22/0061; A63B 22/0064; A63B 22/0066; A63B 22/0069; A63B 23/035; A63B 23/03508; A63B 23/03516; A63B 23/03541; A63B 23/0417; A63B 23/0423; A63B 23/0429; A63B 23/0488; A63B 22/0076–0089; A63B 22/201–208
See application file for complete search history.

(56) References Cited

U.S. PATENT DOCUMENTS 4,730,829 A * 3/1988 Carlson ..... A63B 21/4001 482/901
4,854,578 A * 8/1989 Fulks ..... A63B 21/4035 482/136
5,018,725 A * 5/1991 Cook ..... A63B 21/4035 482/142
5,039,092 A * 8/1991 Olschansky ..... A63B 21/4047 482/130
6,165,110 A * 12/2000 Gajda ..... A63B 21/06 482/102
6,387,024 B1 * 5/2002 Monti ..... A63B 23/03525 482/130
6,685,600 B1 * 2/2004 Ullman ..... A63B 21/156 482/138
7,341,546 B2 * 3/2008 Gautier ..... A63B 23/1245 482/99
7,766,802 B2 8/2010 Webber
8,336,897 B2 12/2012 Leslie
10,279,212 B2 * 5/2019 Dalebout ..... A63B 21/0442
2001/0053734 A1 * 12/2001 Lapcevic ..... A63B 21/08 482/137
2003/0027694 A1 * 2/2003 Harrison ..... A63B 23/1209 482/99
2010/0190617 A1 * 7/2010 Gautier ..... A63B 21/4047 482/94
2012/0115695 A1 * 5/2012 Watterson ..... A63B 23/0216 482/142
2016/0236025 A1 8/2016 Henan
2017/0182359 A1 * 6/2017 Baril ..... A63B 21/012
2021/0170217 A1 * 6/2021 Baluch ..... A63B 23/0233
2022/0347522 A1 * 11/2022 Boddie ..... A61H 1/0281

* cited by examiner

EXERCISE METHOD AND DEVICE

TECHNICAL FIELD

The present invention relates to an exercise method and an exercise device for performing an exercise suitable for thigh and hip muscles such as fitness equipment and an exercise bicycle, and more particularly to an exercise method and an exercise device for strengthening thigh and hip muscles by performing a movement of lowering legs and then moving the legs backward or putting the legs together or apart from a position of pulling the legs toward a chest of the user with an arm disposed between the legs in a sitting or lying position of the user.

BACKGROUND ART

In general, as illustrated in FIG. 1, an exercise for strengthening thigh and hip muscles is performed by pulling legs toward a chest and compressing the legs to the outside by using a pelvis as an axis. However, since a typical exercise method and an exercise device directly transmits a load to an ankle and a knee, ankle and knee joints may be damaged, and a person having weak ankle and knee joints may not perform the exercise method.

In addition, a typical bicycle that is generally used by a knee patient has been developed to go faster more distance with a less force. Thus, as illustrated in FIG. 2, since the bicycle has a pivot axis disposed around an ankle, an exercise is concentrated on lower legs and gives a small effect on upper legs and a hip joint. Thus, a prior bicycle of this inventor expands an exercise range suitable for a motion range of knee joints and the hip joint and increase the exercise effect to be used for exercises.

Specifically, the prior invention of the inventor expands a motion range of the hip joint and the knees by arranging an arm pivot axis of the prior exercise device in parallel to the hip joint in a corresponding manner in order to use the bicycle for exercises.

Also, as a foot plate or a foot pad of the exercise device connected to a weight is positioned on a thigh of an exercising leg, and a movement of raising the exercising leg toward a chest and rotating the leg backward in a sitting or lying position of the user is performed, a force transmitted to the knee and the ankle decreases.

DISCLOSURE OF THE INVENTION

Technical Problem

As illustrated in FIG. 2, a typical fixed-type bicycle that is generally used by a user who has a weak knee has an insignificant effect of strengthening a hip joint because a motion range of the hip joint is restricted, and an axis of a movement is fixed (an exercise range of about 10 to 20). As illustrated in FIG. 1, a general motion range of the hip joint of a human is about 120°. Thus, the prior invention of this inventor expands the motion range such that a pivot axis of an exercise device is disposed parallel to a position of a hip joint of a body of a user, and the user performs an exercise of lowering thighs and moving the thighs backward from a start position of pulling the thighs to a chest of the user. However, the exercise device according to the above-described invention shows a few problems. Thus, technical objects will be described below.

First, the exercise device according to the invention has inconvenience in that the user is necessary to change a seat position during exercises when a single arm and a single pivot part are provided so that a seat does not disturb rotation of the arm, and a pivot axis of the arm corresponds to a hip joint (first problem).

Second, a motion range of a knee and a hip joint is necessary to be changed for each injured portion for rehabilitation treatment. For example, the cruciate ligament tear has a knee motion range that becomes opposite according to whether the portion is anterior or posterior. Also, the motion range of a hip joint exercise is changed for a patient with spinal disc herniation according to injured portions. However, the exercise device according to the prior invention is not suitable for patients with spinal disc herniation, anterior cruciate ligament rupture, and posterior cruciate ligament rupture because the motion range of the hip joint exercise is 120° or more of a normal people (second problem). Thus, an effective rehabilitation exercise device capable of selecting the exercise motion range according to a body state of a patient.

Third, the prior exercise device, in which the pivot axis and the hip joint are disposed parallel to perform a movement of lowering legs and moving the legs backward from a start position in which the user sits on the seat, places the legs on one end of the arm, and pulls the legs toward the chest of the user, causes discomfort because a length of the arm of the exercise device contacting the body is changed according to a rotation angle of the hip joint or the knee joint. For example, a distance from the pivot axis to the pedal decreases when the legs are raised, and the distance increases when the legs are lowered. However, a length of the arm is fixed to cause discomfort. Also, knees are overbent or over-extended to generate side effects (third problem). Thus, the length of the arm is necessary to be varied according to the variation of the length of the leg to the pivot axis.

Fourth, the exercise device according to the prior invention causes discomfort because the pedal rotates by using a bar as an axis when a foot is placed on the pedal to perform a linear movement.

Fifth, in case of a typical bicycle, the arm rotates by 360° to automatically move from an exercise end section to an exercise start section. In case of the exercise device according to the prior invention, the exercise section is within 180°, the arm does not return from the end section to the start section.

Sixth, in case of an axis conversion device of the exercise device according to the prior invention, when a roller connected to a resistance body is hinged from x-axis parallel to the ground to a y-axis perpendicular to the ground, the roller is easily worn because a wire is not fixed to the roller, and thus the wire hits the roller.

Seventh, the exercise device according to the prior invention requires expensive manufacturing costs because each of a y-axis pivot axis connected to the arm and a bevel gear set is provided in plurality and is easily broken as a volume of a gear device increases.

Eighth, the exercise device according to the prior invention may not perform a basic leg muscle resistance exercise such as squat, lunge, and deadlift. In case of the exercise device according to the prior invention, a handle hits the body of the user like an exercise device suitable for the thigh and hip muscles such as a total hip machine.

Ninth, the exercise device according to the prior invention may perform a leg exercise, but may not perform an upper body exercise.

Tenth, the exercise device according to the prior invention occupies a wide space when stored indoor.

Technical Solution

In order to solve the first problem, an exercise device according to the present invention is configured such that it comprises a seat 4 connected to a back part 1*ab* of the base frame 1*a*, wherein, in a plan view, the front vertical post 1*b* connected to a front part 1*aa* of the base frame 1*a* and aligned along a virtual horizontal centerline d of the seat 4 (FIG. 5); a guiding rail 2, wherein the guiding rail extends from a top to a bottom in a curved shape such that, in a side view, the guiding rail is in a curved line shape (FIG. 4); and the guiding rail has a pivot point 6*a* on a coronal plane (FIG. 8) and is pivotably connected to the said vertical post 1*b*; a slide arm 3, wherein the slide arm is slidably connected to the guiding rail and extends horizontally from a left or right side of the guiding rail (FIGS. 3-5) and the slide arm is configured to slide up and down along the guiding rail from a start position of an exercise at a top part of the guiding rail, to an end position of the exercise at a bottom part of the guiding rail, and the slide arm comprises a leg pad 5 supported thereon, wherein, in a first configuration, a longitudinal axis of the guiding rail is positioned perpendicularly to a ground, such that a longitudinal axis of the sliding arm is disposed parallel to the ground; and in a second configuration, the longitudinal axis of the guiding rail is positioned parallel to the ground, such that the longitudinal axis of the sliding arm is disposed perpendicularly to the ground. (KR 20-2020-0001877).

In order to solve the third problem, the exercise device according to the present invention performs a movement in which a portion of the body connected to the arm rotates and simultaneously compresses by providing a shock absorber to the arm having one end connected to a pivot axis and allows a length of the arm to be extended and then restored through the shock absorber when a length of legs are changed according to a rotation angle. The shock absorber may have a gas cylinder shape and apply a resistive force by a spring in addition to gases (KR 10-2021-0040066).

In order to solve the fourth problem, the exercise device according to the present invention is configured such that as a pipe and a bar that linearly moves in the pipe are provided to the arm instead of the shock absorber, a portion of the body connected to the arm rotates and simultaneously compresses, and the length of the arm is extended and then restored to an original state through the pipe and a bar 11 that linearly moves in the pipe. In addition, as a second pipe 22 connected parallel to the pipe is provided, a second bar 21 is provided in the second pipe, and a second bar fixing body 20 is provided on the bar, when the bar linearly moves from the inside to the outside of the pipe, the second bar also linearly moves from the inside to the outside of the pipe, so that the pedal does not rotate about the bar (KR 10-2021-0046163, KR 10-2021-0046813). Through the above-described invention, an effect of simultaneously performing a rotation exercise and a compression exercise is generated.

In order to solve the fifth problem, the exercise device according to the present invention is configured such that as the axis is separated into a left side and a right side, and the left and right sides are organically connected by using a gear and a roller, the exercise device is returned from an exercise end section to an exercise start section (KR 20-2020-0152414).

In order to solve the sixth problem, the exercise device according to the present invention is configured to move on an x-axis parallel to the ground and rotate on a y-axis perpendicular to the ground by using a spiral gear or a bevel gear. In addition, as the gear device is manufactured to have a gear box shape, a user may attach the gear device to an existing exercise device in order to recycle the existing exercise device. Furthermore, as a time belt, a belt, and a sprocket are inserted into a pipe having a rectangular shape or a pipe shape provided below the seat, a belt pulley or a sprocket is connected to the gear device according to the present invention, and the belt pulley is connected to a resistive body of the existing bicycle (KR 10-2020-0152414, KR 10-2020-0153238, KR 10-2020-0170941, 10-2020-0179121, 10-2021-0002955, KR 10-2020-0179121).

Advantageous Effects

Hereinafter, advantageous effects of the present invention will be described.

First, the exercise device according to the present invention may simply strengthen the thigh and hip muscles instead of changing the position of the seat by the user or providing two arm pivot parts to both the sides (KR20-2020-0001877).

As a result, the user who have the weak knee and ankle joints or the user who wants to strengthen the thigh and hip muscles without strain of the joints may perform the thigh and hip muscle strengthening exercise by using the exercise method and the exercise device to strength the muscles, ultimately reduce the risk of disease such as diabetes, prevent obesity, and promote health after the middle age. Also, the present invention helps to aesthetically shape the body and athletes to improve the sports ability without strain of the knee and ankle joints.

Second, the exercise device according to the present invention increases the exercise effect by applying the rotational force and the compressional force in a complex manner and performs the exercise similar to the natural movement, and when the user performs the exercise of pulling the legs toward the chest and then lowering the legs and rotating backward through the movement in which the bar linearly moves in the pipe, the length of the arm is flexibly extended and then automatically restored according to the substantial variation of the legs contacting the arm during the hip joint pivot exercise (KR 10-2021-0040066). Third, the left and right arms of the exercise device organically rotate by using the roller and are automatically restored from the exercise end section to the exercise start section.

Fourth, the gear device moves on the x-axis parallel to the ground or rotates on the y-axis perpendicular to the ground by using the bevel gear or the spiral gear to solve the phenomenon of abrasion of the wire connected to the roller, and the resistive body of the existing bicycle may be used by attaching the gear device to the existing bicycle to solidify the technology of the exercise device according to the prior invention and recycle the existing bicycle (KR 10-2020-0152414, KR 10-2020-0153238, KR 10-2020-0163490).

BRIEF DESCRIPTION OF THE DRAWINGS

FIG. 26 is a front view illustrating a gear device of an embodiment of the present invention, including a single y-axis that is perpendicular to the ground;

DETAILED DESCRIPTION OF THE INVENTION

Figure 1:
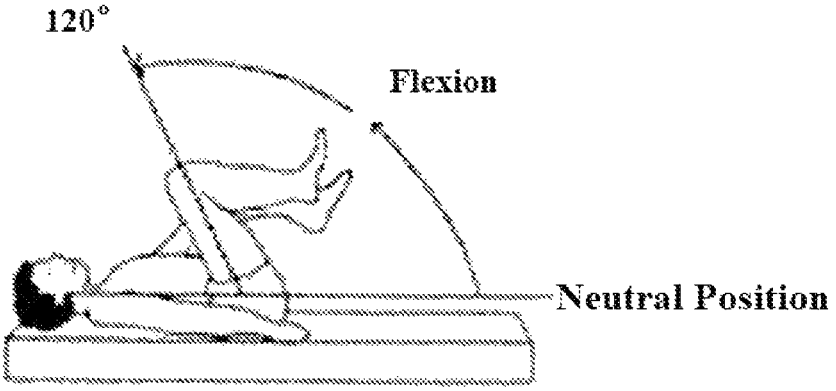
Figure 1 Prior Art
FIG. 1 illustrates general hip rotation using a pelvis as an axis.
Figure 2:
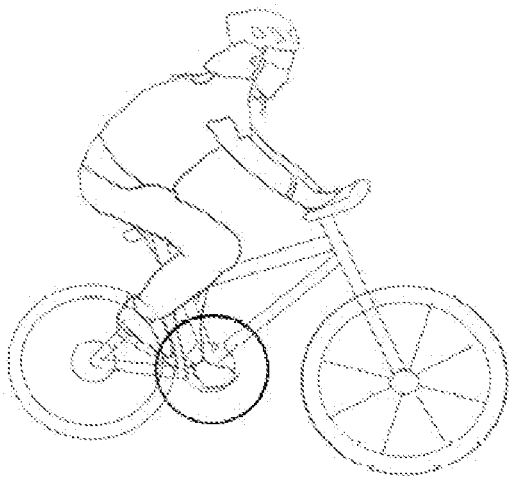
Figure 2 Prior Art
FIG. 2 illustrates the general bicycle pivot axis disposed around an ankle.

Embodiments of the present invention provide an exercise device that is a bicycle, an indoor bicycle, or fitness equipment, the exercise device including a frame 1, a handle 7 connected to the frame, a seat 4 connected to the frame, a pivot axis 11 connected to the frame 1, an arm 10 connected to the pivot axis, a pipe 12*a* connected to the arm, and a bar 12*b*, that linearly moves in the pipe, so that a user performs a movement of lowering legs and moving the legs backward by using a hip joint of the user as an axis from a start position in which the user sits or lies on the seat 4, places the legs on the leg pad, and pulls the legs toward a chest of the user.

Hereinafter, detailed descriptions related to well-known functions or configurations will be ruled out in order not to unnecessarily obscure subject matters of the present invention. Since the present invention may, however, be embodied in different forms and various modifications and variations can be made in the present invention, specific embodiments will be described in detail with reference to the accompanying drawings. However, this does not limit the present invention within the specific embodiments and it should be understood that the present invention covers all the modifications, equivalents, and replacements within the idea and technical scope of the present invention. In the following description, the technical terms are used only for explaining a specific example (or embodiment) while not limiting the present disclosure. In the present invention, the meaning of 'include' or 'comprise' specifies a property, a fixed number, a step, an operation, an element, a component, or a combination thereof but does not exclude other properties, fixed numbers, steps, operations, elements, components, combinations thereof.

Hereinafter, an embodiment of a quads and gluteus exercise of the present invention to achieve the above-described objects will be described in detail with reference to the accompanying drawings.

In order to resolve a first problem of the technical object, as illustrated in FIGS. 3 to 8 (KR 20-2020-0001877), an exercise device of the present invention, which performs an exercise suitable for a quads and gluteus exercise, may include: a frame 1; a seat 4 connected to the frame 1 and allowing a user to have a sitting position; a guiding rail 2 connected to the frame 1; a slide arm 3 slidingly moving with a guiding range of the guiding rail 2; and a leg pad connected to one end of the slide arm 3 and disposed below legs of the user or disposed to contact a rear surface of the legs of the user. To explain more specifically based on FIGS. 3 to 8, the exercise device may comprise a front vertical post 1*b* connected to a front part 1*aa* of a base frame 1*a*; a seat 4 connected to a back part 1*ab* of the base frame 1*a*, wherein, in a plan view, the front vertical post 1*b* is aligned along a virtual horizontal centerline d of the seat 4 (FIG. 5); a guiding rail 2, wherein the guiding rail extends from a top to a bottom in a curved shape such that, in a side view, the guiding rail is in a curved line shape (FIG. 4); and the guiding rail has a pivot point 6*a* on a coronal plane (FIG. 8) and is pivotably connected to the said vertical post 1*b*; a slide arm 3, wherein the slide arm is slidably connected to the guiding rail and extends horizontally from a left or right side of the guiding rail (FIGS. 3-5) and the slide arm is configured to slide up and down along the guiding rail from a start position of an exercise at a top part of the guiding rail, to an end position of the exercise at a bottom part of the guiding rail, and the slide arm comprises a leg pad 5 supported thereon, wherein, in a first configuration, a longitudinal axis of the guiding rail is positioned perpendicularly to a ground, such that a longitudinal axis of the sliding arm is disposed parallel to the ground; and in a second configuration, the longitudinal axis of the guiding rail is positioned parallel to the ground, such that the longitudinal axis of the sliding arm is disposed perpendicularly to the ground.

Figure 5:
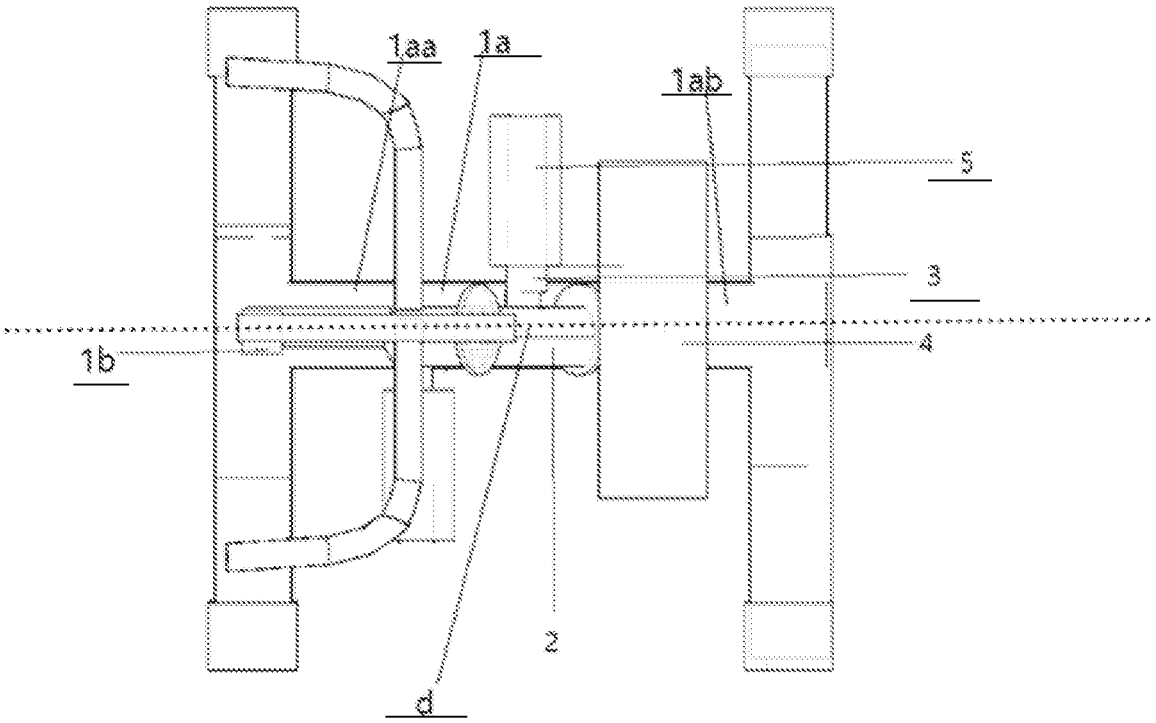
FIG. 5 is a plan view of an embodiment of the present invention illustrating a guiding rail adjusted in a direction perpendicular to the ground.

Also, as the slide arm 3 and the guiding rail 2 are provided so that the slide arm 3 moves along the guiding rail 2 to allow the slide arm 3 to rotate about a pivot axis disposed in a hip joint of the user, the pivot axis of the slide arm 3 rotating along the guiding rail 2 may be disposed corresponding to the hip joint of the user, and as the guiding rail 2 is disposed between both legs of the user when viewed on a plan view as illustrated in FIG. 5, the user may perform a movement in which the user sitting or lying on the seat 4 puts both the legs on the leg pads and alternately lowers the legs and moves the legs backward from a start position in which the legs are pulled toward the user's chest.

Preferably, the leg pad is necessary to be disposed on a rear surface of a thigh of the user to protect knees and ankle joints of the user. Also, as illustrated in FIGS. 3, 6, and 7, a foot plate or a pedal may be connected to one end of the leg pad 5.

Figure 7:
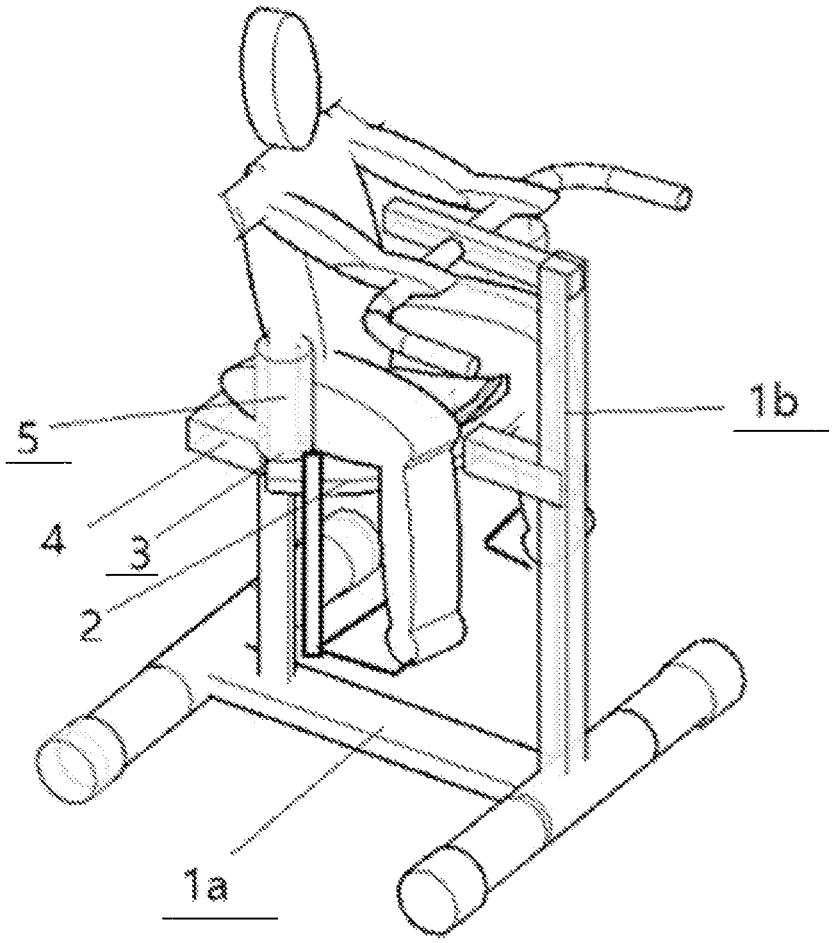
FIG. 7 is a perspective view of an embodiment of the present invention illustrating a guiding rail adjusted in a direction parallel to the ground.
Figure 8:
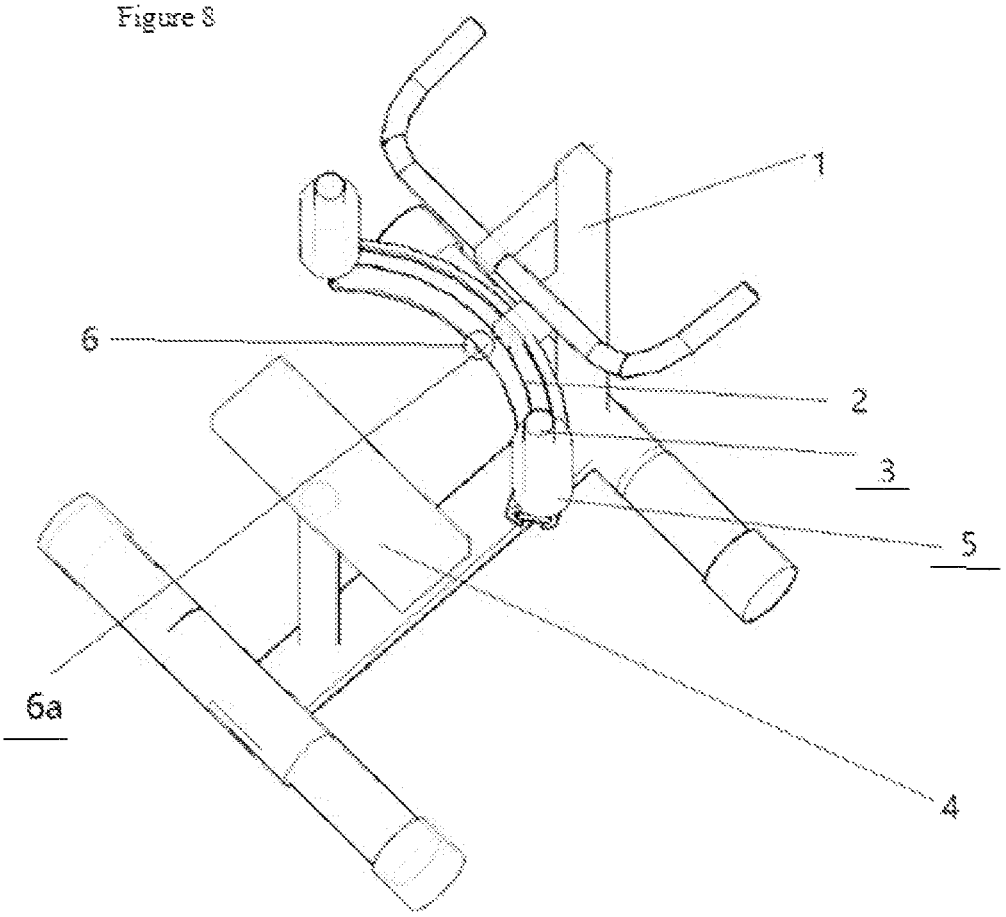
FIG. 8 is a perspective view of an embodiment of the present invention illustrating a guiding rail adjusted in a direction parallel to the ground.
Figure 9:
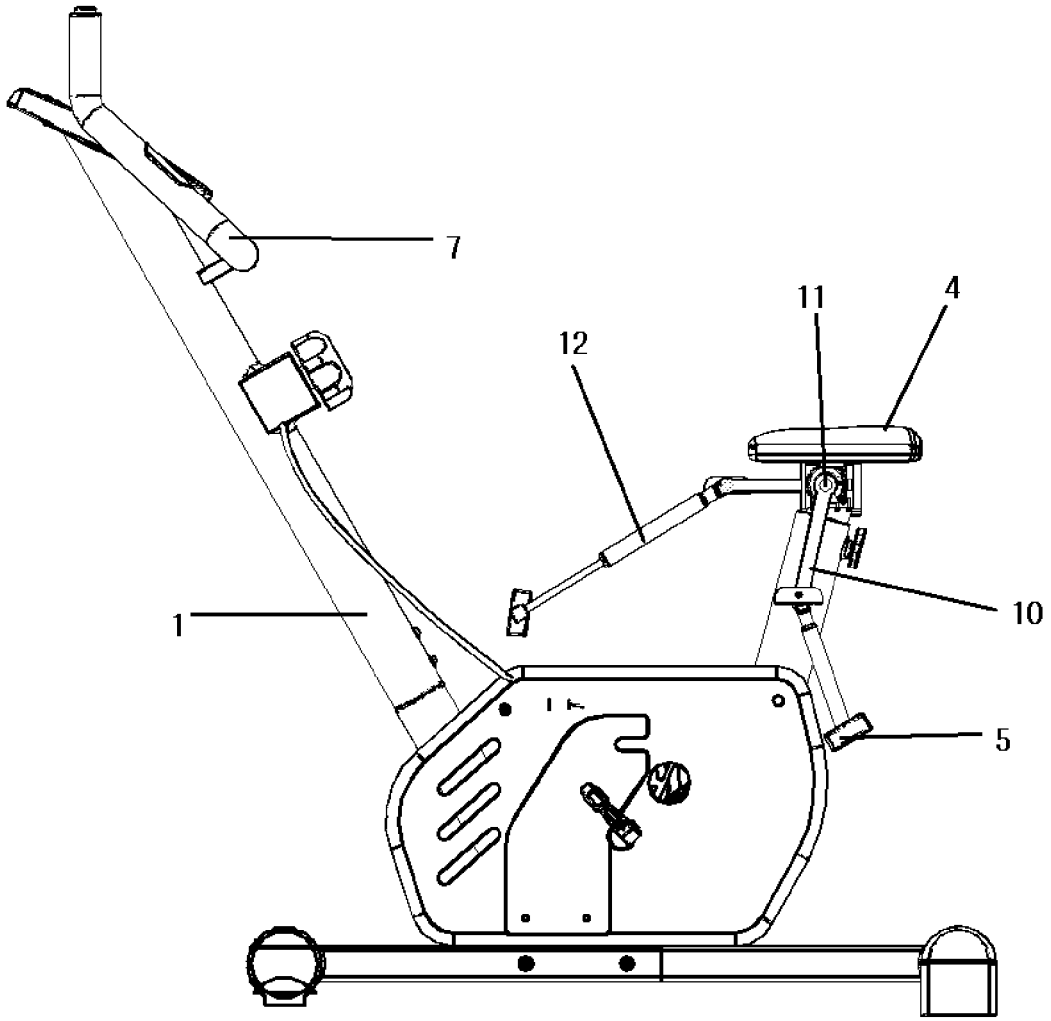
FIG. 9 is a side view of an embodiment of the present invention illustrating an arm having an end connected to a pivot axis 11 and a second end coupled to an end of an arm elongation means 12.
Figure 10:
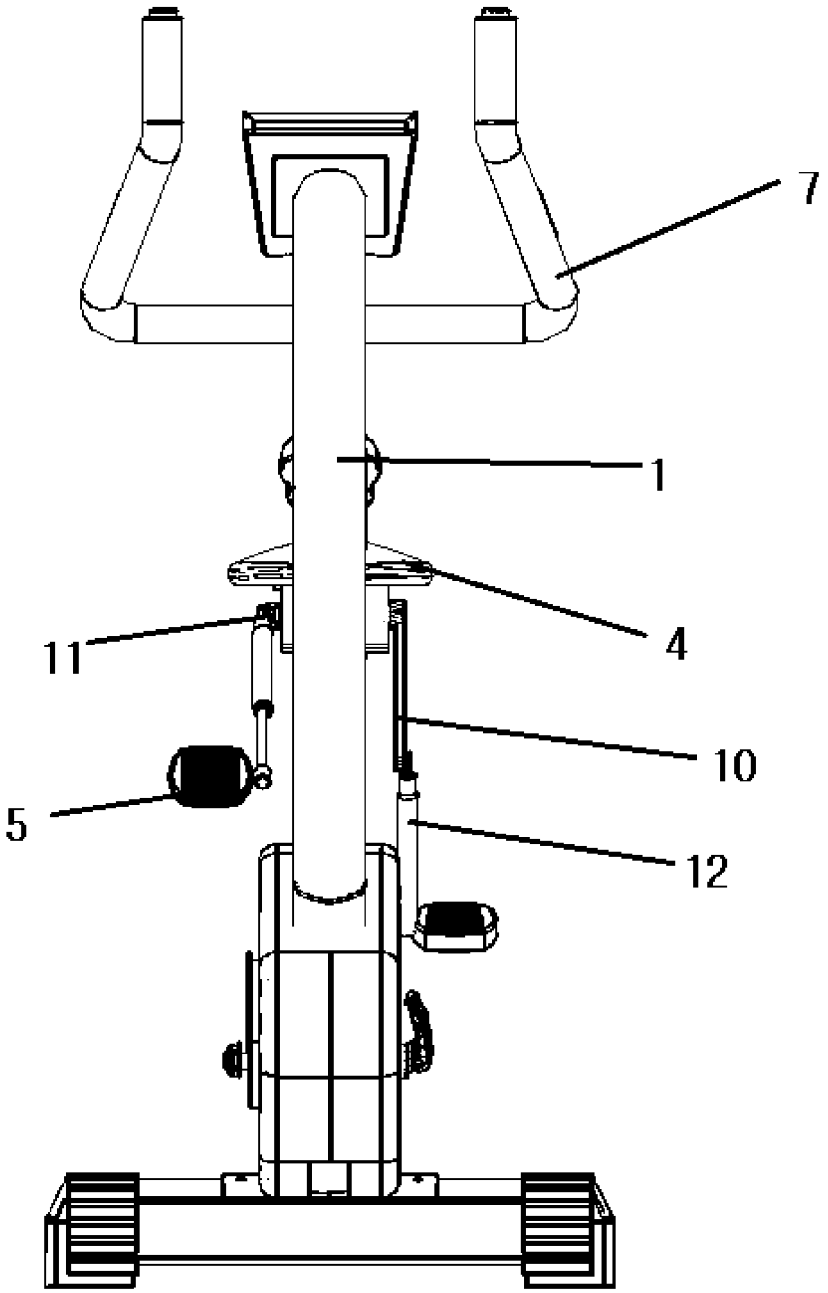
FIG. 10 is a front view of an embodiment of the present invention illustrating an arm 10 having an end connected to a pivot axis 11 and a second end coupled to an arm elongation means 12.
Figure 11:
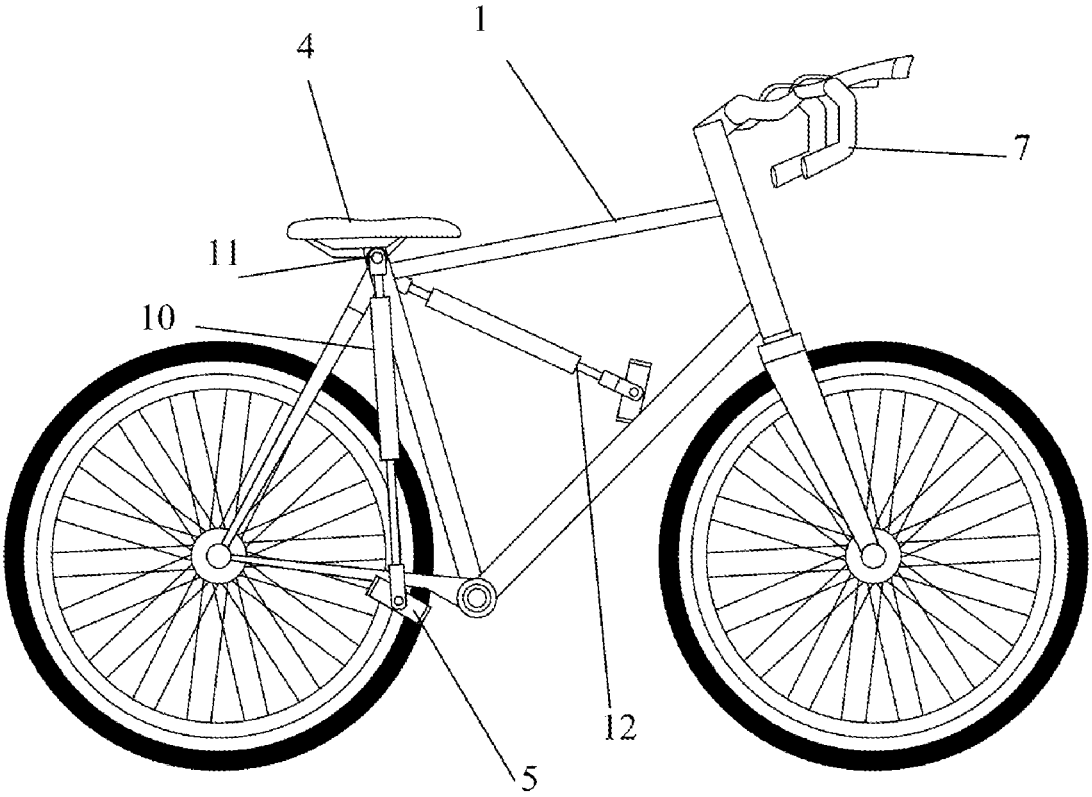
FIG. 11 is a side view of an embodiment of the present invention illustrating an arm 10 having an end connected to a pivot axis 11 and a second end coupled to an end of an arm elongation means 12 arranged linearly with the arm 10.

In addition, preferably, as illustrated in FIG. 8, the exercise device may be configured to adjust suitably for a portion of a user's body that the user wants to exercise as the guiding rail 2 connected to the frame 1 includes an axis conversion part that converts the guiding rail in a direction parallel to the ground (FIGS. 6, 7, and 8), in a direction perpendicular to the ground (FIGS. 3, 4, and 5), and in a diagonal direction when an angle to the ground is 45°.

Figure 3:
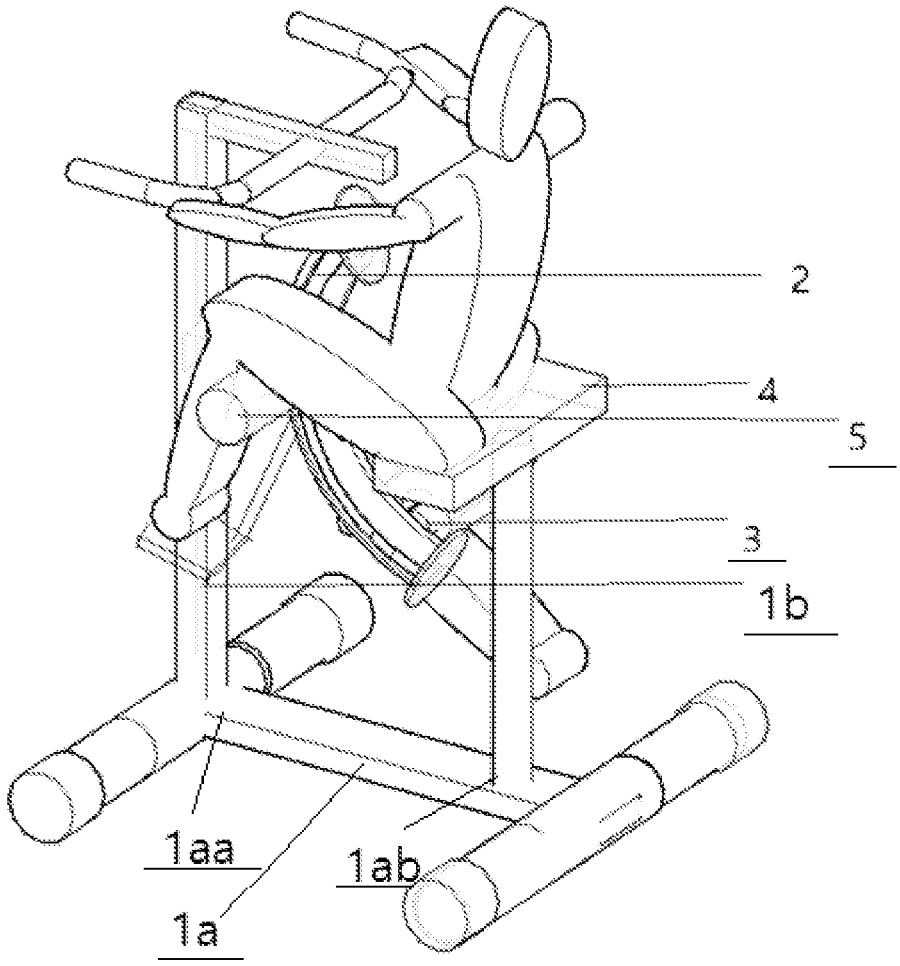
FIG. 3 is a perspective view of an embodiment of the present invention illustrating a guiding rail adjusted in a direction perpendicular to the ground.
Figure 4:
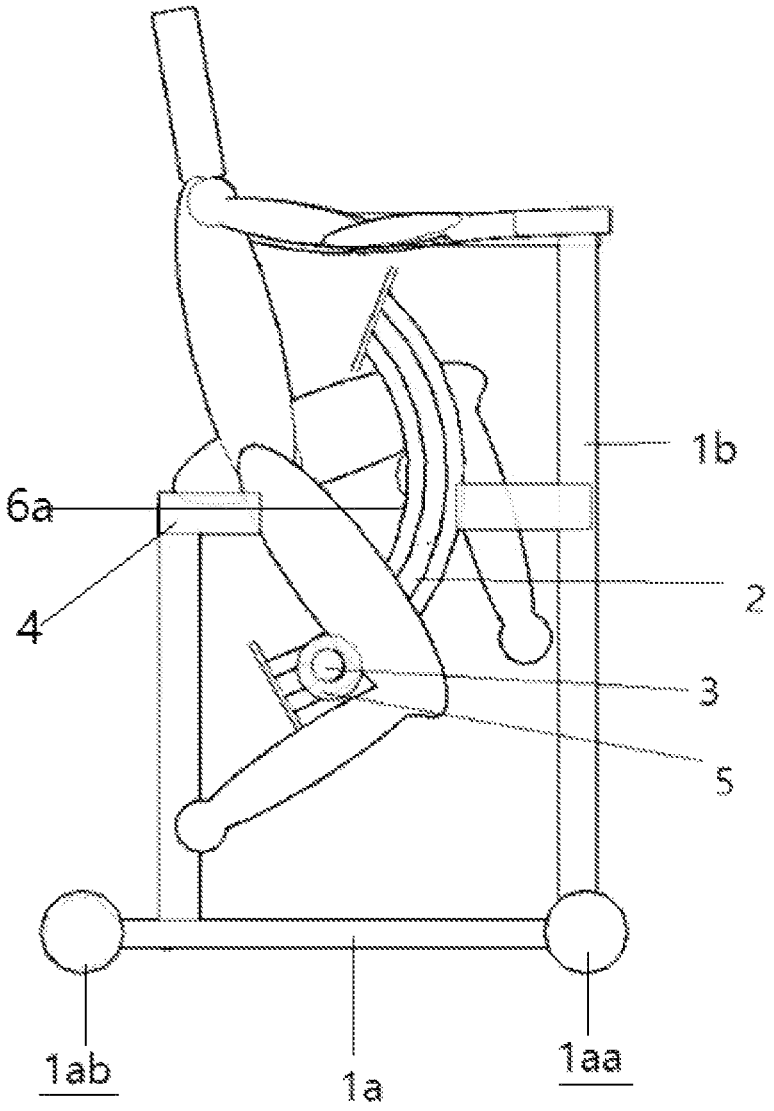
FIG. 4 is a side view of an embodiment of the present invention illustrating a guiding rail adjusted in a direction perpendicular to the ground.
Figure 6:
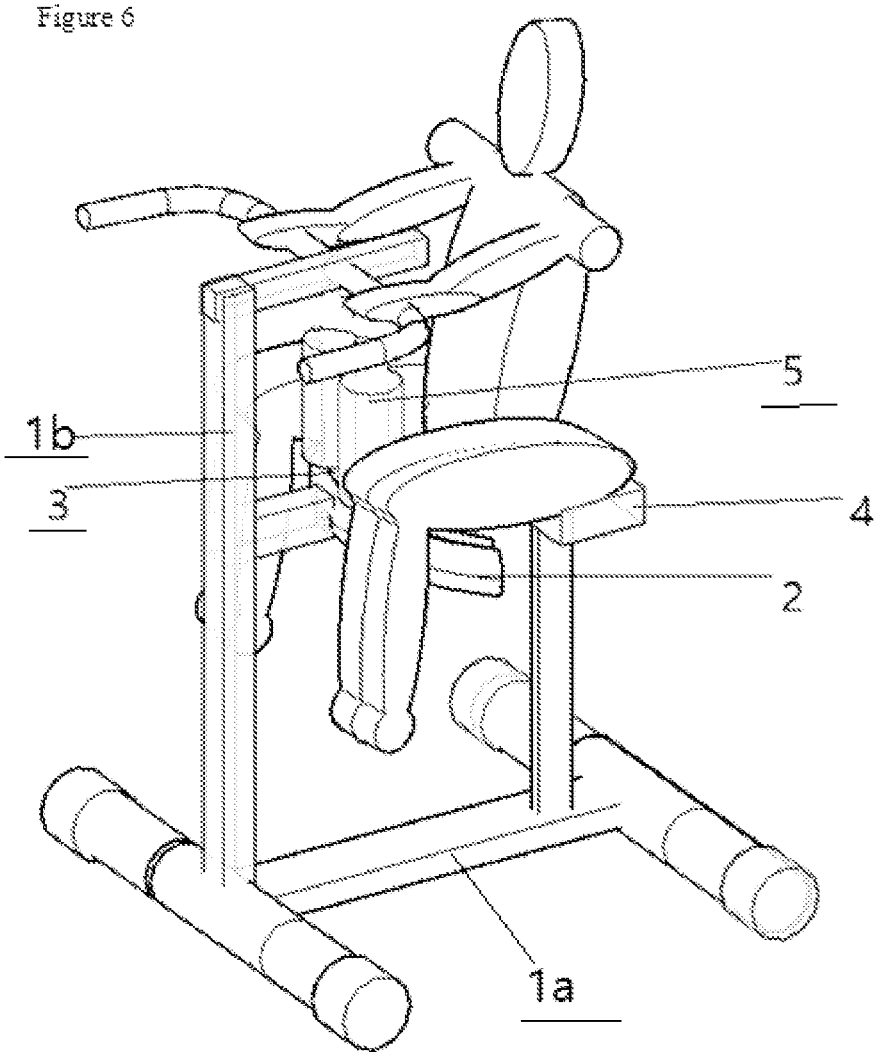
FIG. 6 is a perspective view of an embodiment of the present invention illustrating a guiding rail adjusted in a direction parallel to the ground.

The guiding rail 2 may be disposed perpendicularly to the frame 1 as illustrated in FIGS. 6, 7, and 8 or pivotably provided horizontally to the frame 1 as illustrated in FIGS. 3, 4, and 5, and the axis conversion part may include a fixing unit 6 for fixing the guiding rail 2 to the frame 1. Thus, the user may selectively perform a rotation movement of selectively lowering the legs and moving the legs backward from the start position in which the legs are pulled toward the user's chest, a movement of spreading both the legs apart and then putting the legs together as illustrated in FIG. 6, or a movement of spreading the legs from the start position of putting the legs together as illustrated in FIG. 7.

Preferably, the exercise device of the present invention may include a resistive force generator for generating a resistive force against pivoting of the slide arm 3. The resistive force generator may use a method of using a physical friction such as a tension of a belt and a magnetic drum and include a fluid resistor or a block box connected with a pneumatic pressure, a circular plate, and a wire.

In order to resolve a third problem of the technical object, as illustrated in FIGS. 9 to 12 (KR10-2021-0040066), the exercise device according to the present invention may include: a frame 1; a handle 7 connected to the frame 1; a seat 4 connected to the frame 1; a pivot axis 11 connected to the frame 1 and disposed in parallel to the hip joint of the user; an arm 10 connected to the pivot axis; and a shock absorber 12 connected to the arm. The exercise device may allow a user to perform an exercise similar to a natural movement of a body of the user by pivoting a portion of a body connected to the arm and simultaneously performing a compression movement, and may be flexibly extended in length and automatically restored based on a different in body length caused by folding and unfolding of the hip joint and knees of the user by installing the shock absorber.

The shock absorber may apply a resistive force to the inside thereof by pressing, hydraulic pressure, and spring elasticity according to the typical technology. The shock absorber may be contracted and then extended or extended and then contracted on the contrary. Preferably, the shock absorber may be integrated with the arm or arranged linearly with the arm when viewed on a sagittal plane.

In addition, a muscle resistance according to the pivot exercise may increase by connecting a resistance body to the pivot axis. When an embodiment of the present invention is used as an indoor bicycle, a motion range of the bicycle may be extended, and an exercise effect may increase.

Also, an exercise device of the related art in which a pivot axis of an arm is disposed parallel to the hip joint or the knees causes inconvenience because the arm of the exercise device, which contacts a body according to a pivot angle of the hip joint or the knees, has a constant length. For example, since a distance from the pivot axis to the pedal decreases when legs are raised, and the distance increases when the legs are lowered, the fixed length of the arm causes inconvenience, and the knees are over-bent or over-extended to cause side effects. However, in the present invention, the distance may be flexibly extended and then automatically restored according to the difference of the body length when folded and unfolded by installing the shock absorber.

Figure 12:
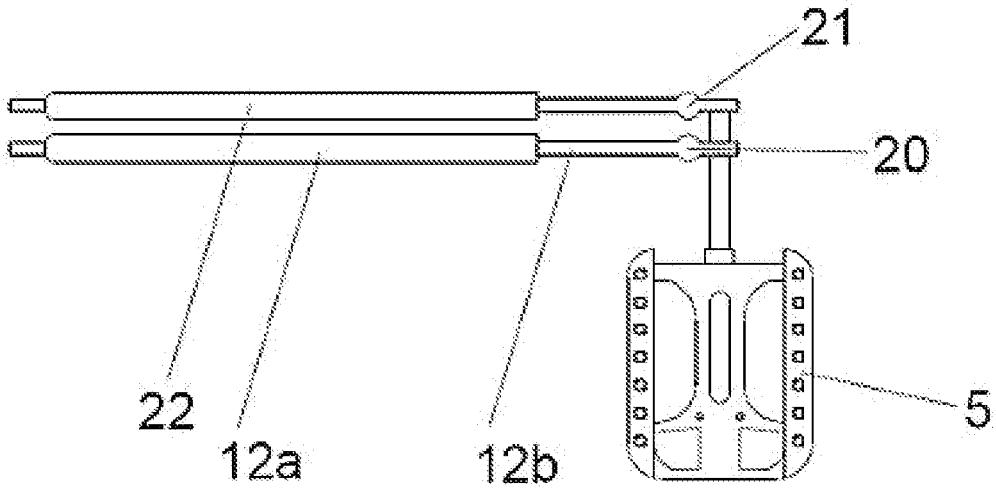
FIG. 12 is a partial view of an embodiment of the present invention illustrating an arm elongation means 12 having a straight line-shaped pipe 12*a* and a straight line-shaped bar 12*b* disposed inside the pipe to move vertically.

In order to resolve the third problem of the technical object, as illustrated in FIG. 12 (KR 10-2021-0046163), the exercise device according to the present invention may include: a frame 1; a handle 7 connected to the frame; a seat 4 connected to the frame; a pivot axis 11 connected to the frame 1; an arm 10 pivotably connected to the pivot axis; a pipe 12*a* having a straight line shape and disposed linearly to the arm; and a bar 12*b* having a straight line shape and disposed inside the pipe to vertically move. Here, as the pedal is connected to the bar 12*b*, the user may perform a movement of raising the legs toward the chest and then pivoting the legs around the hip joint and simultaneously pulling and compressing the legs in a state in which the user put the legs on the pedal. Through this, as the rotation exercise and the compression exercise are simultaneously performed, the exercise similar to the natural movement of the body may be performed, and when the user sits on the seat to raise the legs toward the chest and then lower the legs and pivot the legs backward through the linear movement of the bar in the pipe, the length of the arm may be flexibly extended and then automatically restored according to the substantial variation in length of the legs contacting the arm caused by the pivoting exercise of the hip joint.

According to a typical technology through a pipe 12*a* and the bar 12*b* disposed in the pipe, the resistive force may decrease by the inner pneumatic pressure or hydraulic pressure or the spring elasticity, and the pipe 12*a* and the bar 12*b* may be contracted and then extended or extended and then contracted on the contrary. Also, a muscle resistance according to the pivot exercise may increase by connecting a resistance body to the pivot axis.

When an embodiment of the present invention is used as an indoor bicycle, a motion range of the bicycle may be extended, and an exercise effect may increase.

Figure 44:
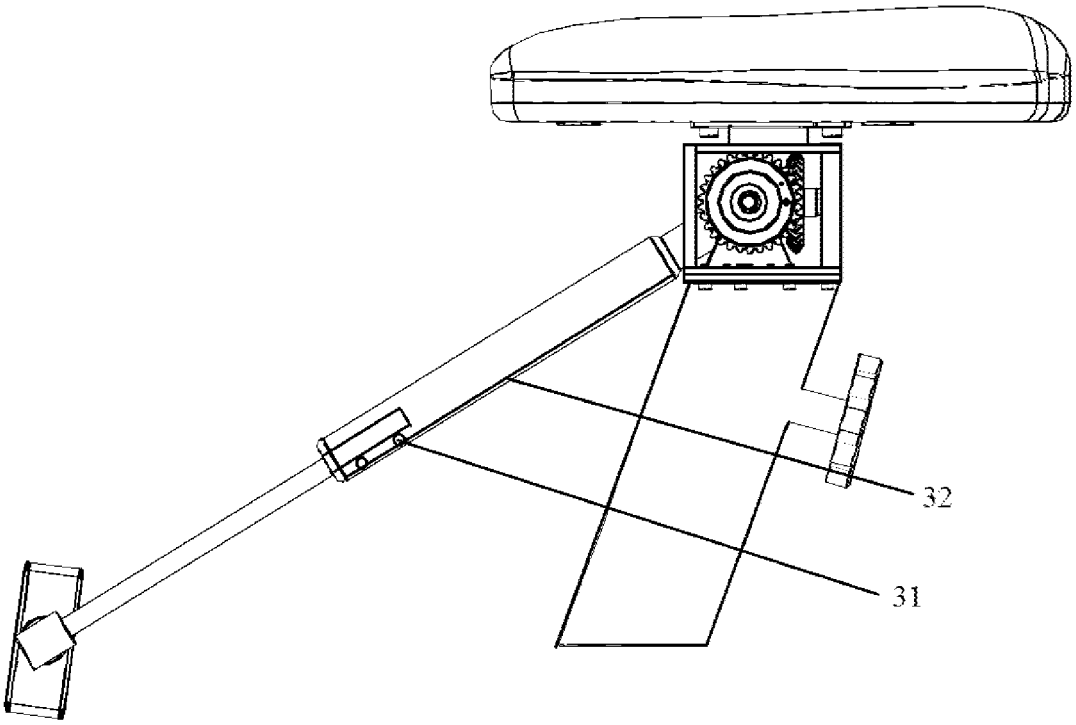
FIG. 44 is a perspective view of an embodiment of the present invention illustrating a guide rail 32, and a roller 31.

In order to resolve a fourth problem of the technical object, as illustrated in FIG. 12 (KR 10-2021-0046163), the exercise device according to the present invention may include: a second pipe connected in parallel to the pipe; a second bar disposed in the second pipe; and a second bar fixing body disposed on the bar, so that the pedal does not rotate around the bar as the second bar linearly moves to the outside from the inside of the second pipe when the bar linearly moves to the outside form the inside of the pipe. Thus, when the user performs a compression exercise from a start position of putting the legs on the pedal and pulling the legs, the pedal may linearly move instead of rotating. In addition, as illustrated in FIG. 44 (KR 10-2021-0046813), the pedal may not rotate around the pipe by selectively providing a guide rail 32 to the pipe and a roller 31 to the bar and selectively forming a groove in the bar or cutting one surface of the bar and providing a projection on the pipe.

Figure 13:
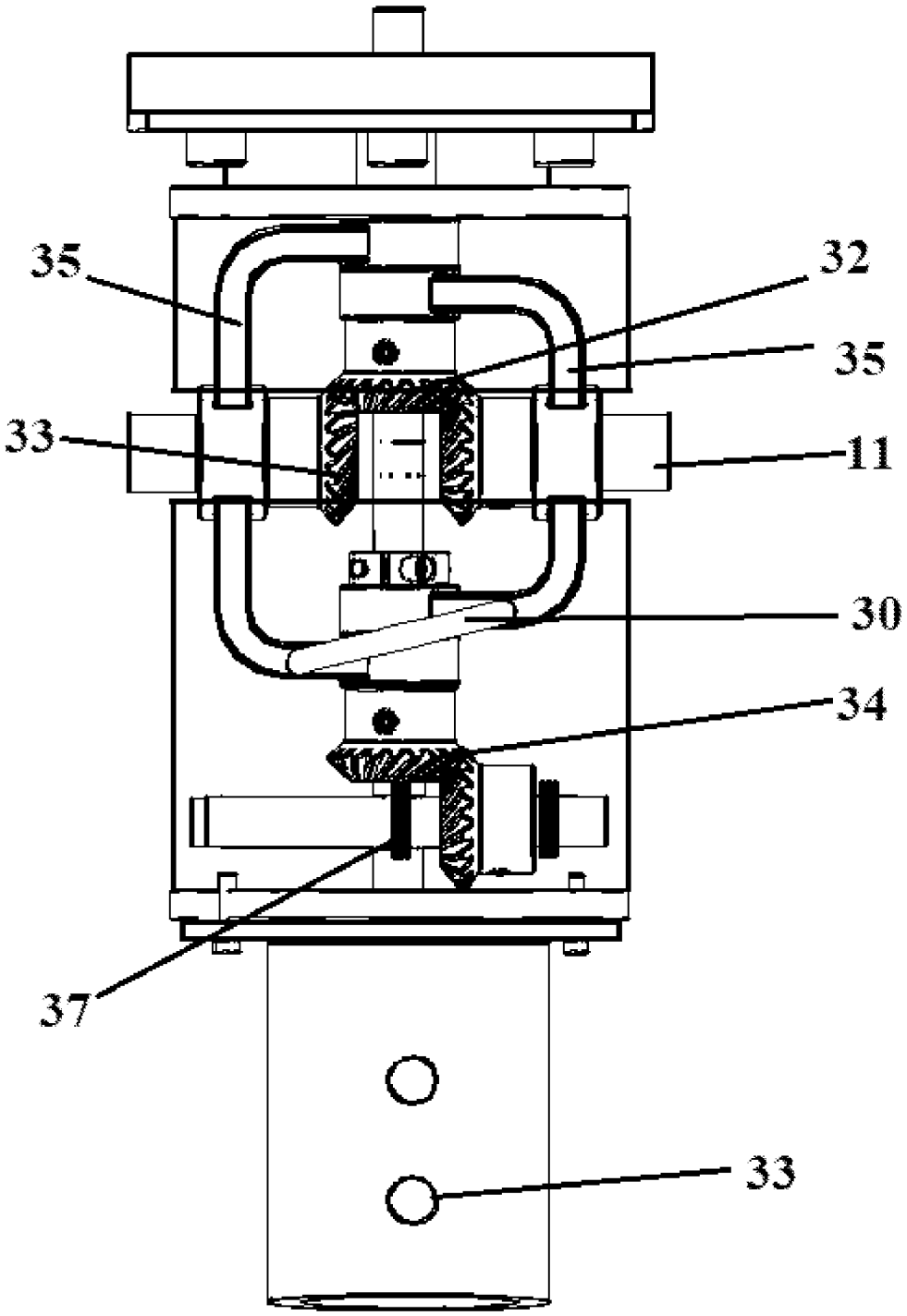
FIG. 13 is a partial view of an embodiment of the present invention illustrating an axis conversion gearbox.
Figure 14:
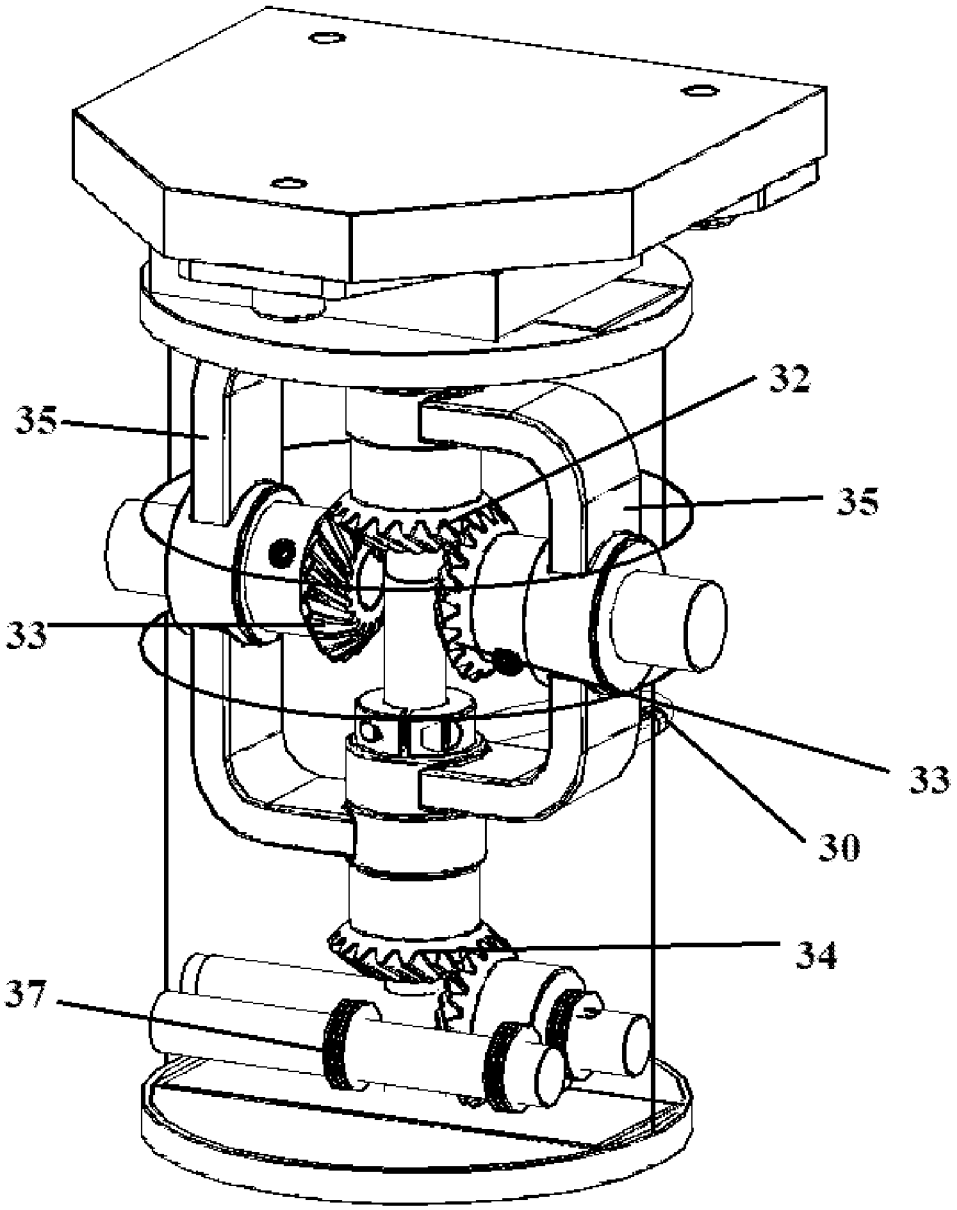
FIG. 14 is a partial view of an embodiment of the present invention illustrating an axis conversion gearbox.
Figure 15:
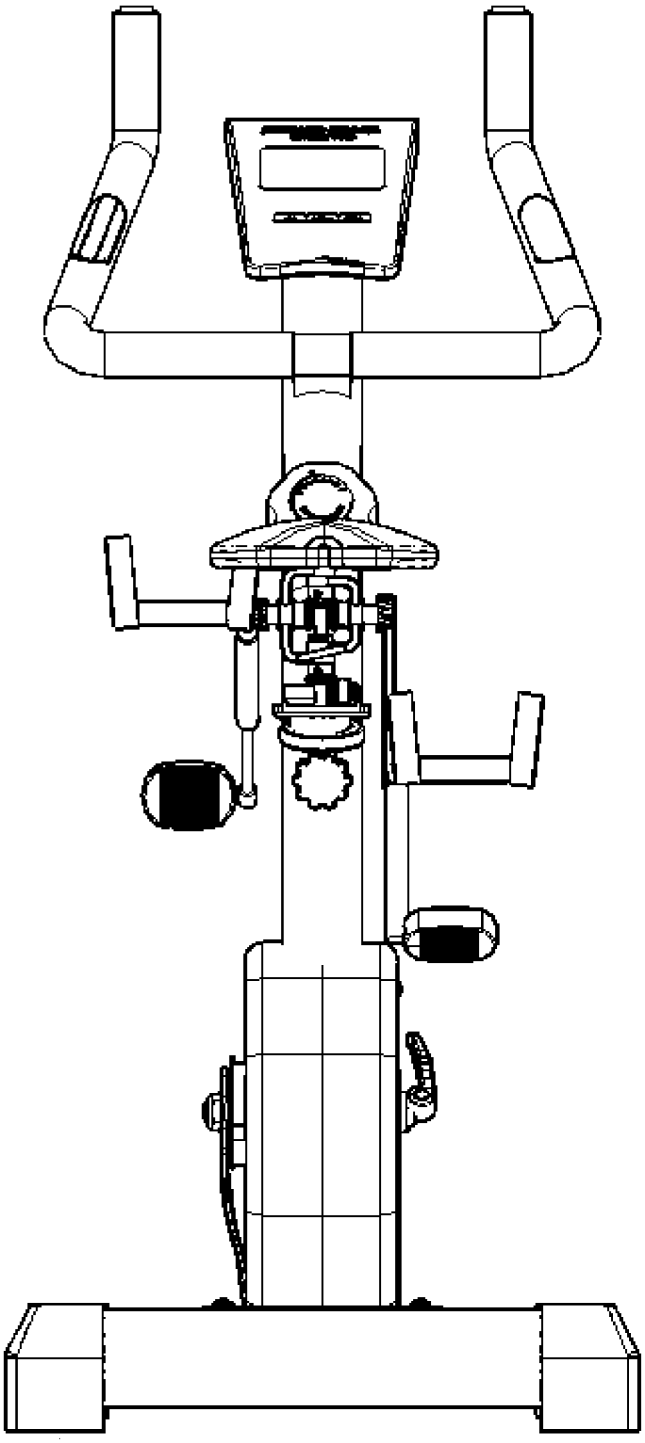
FIG. 15 is a front view of an embodiment of the present invention illustrating a gearbox of FIGS. 13, 14 attached in a bicycle.
Figure 16:
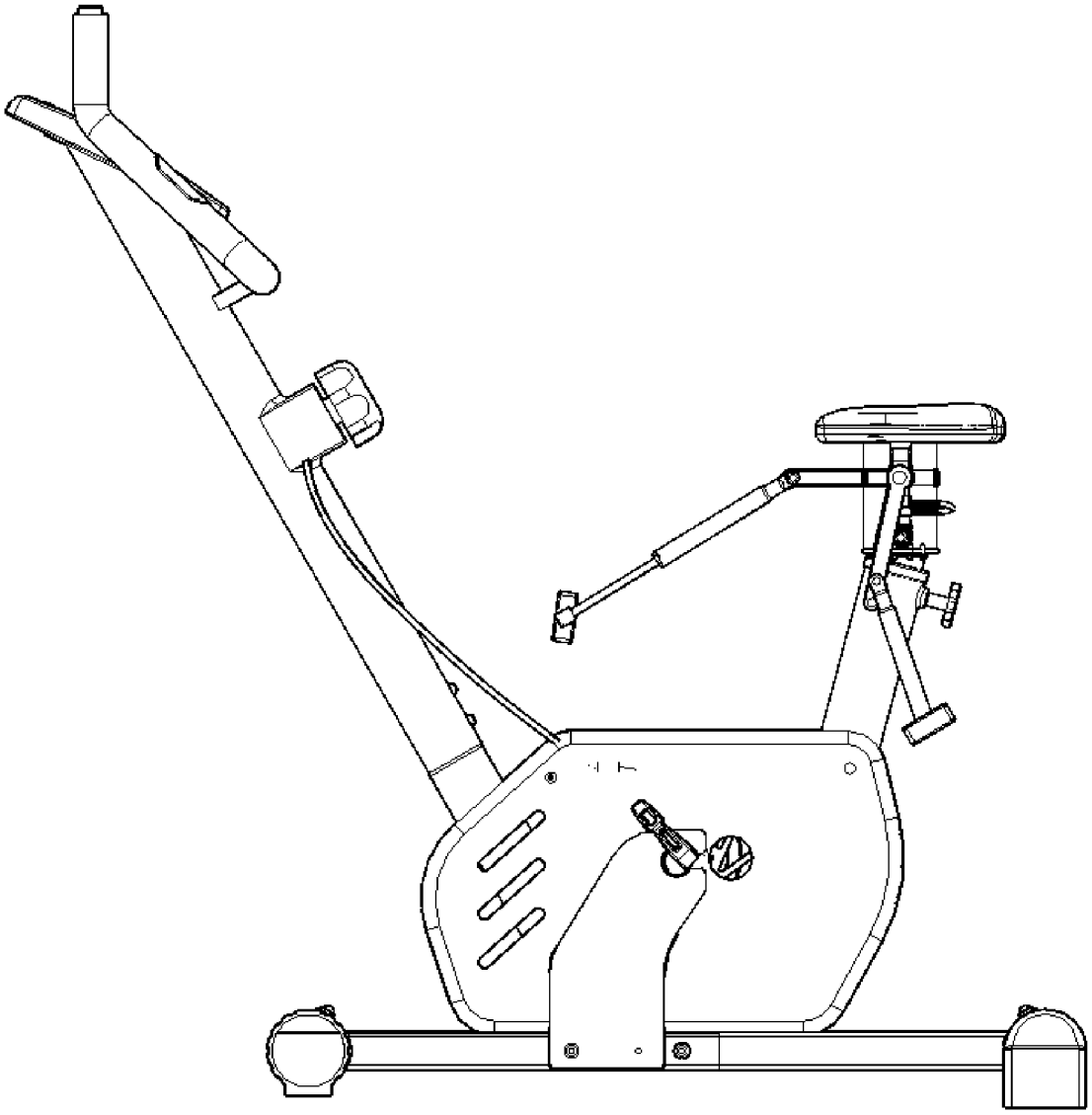
FIG. 16 is a side view of an embodiment of the present invention illustrating a gearbox of FIGS. 13, 14 secured in a bicycle.

In order to resolve a fifth problem of the technical object, as illustrated in FIGS. 13 to 44, the exercise device according to the present invention may include a gear device allowing left and right arms of the exercise device to organically rotate by using the gear and the roller and be automatically restored from an exercise ending position to the start pose, and to move on the axis parallel to the ground or rotate around the axis perpendicular to the ground, and as the gear device is attached to an existing bicycle to use a resistive body of the existing bicycle, the technology of the exercise device according to the related art may be realized, and the existing bicycle may be recycled. FIGS. 13 and 14 are views illustrating an axis conversion gear box according to an embodiment of the present invention, and FIGS. 15 and 16 are views illustrating a state in which the axis conversion gear box is attached to an indoor bicycle according to an embodiment of the present invention.

Figure 17:
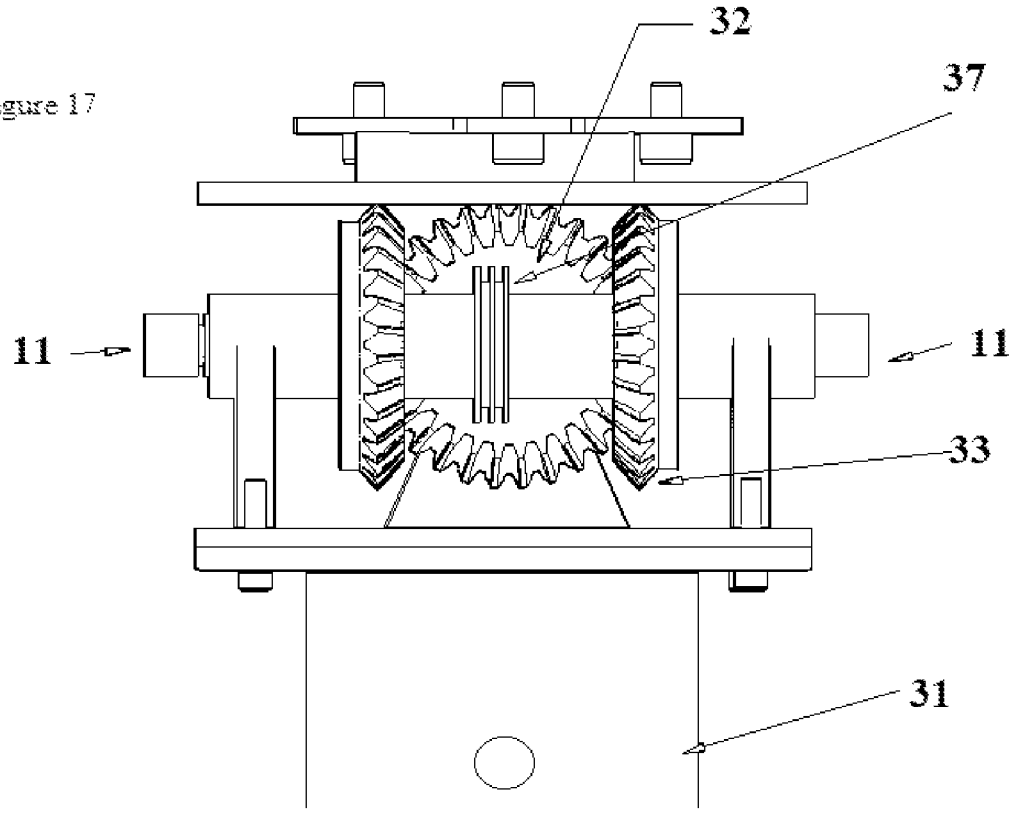
FIG. 17 is a partial view of an embodiment of the present invention illustrating a gear device in which an axis conversion device is not provided.
Figure 18:
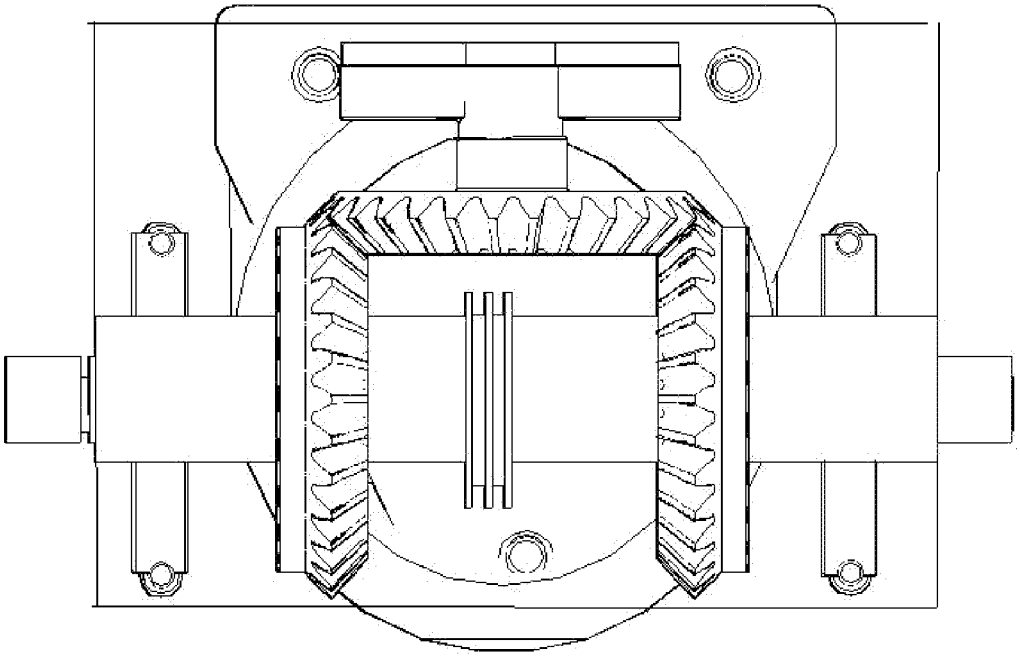
FIG. 18 is a partial view of an embodiment of the present invention illustrating a gear device in which an axis conversion device is not provided.
Figure 19:
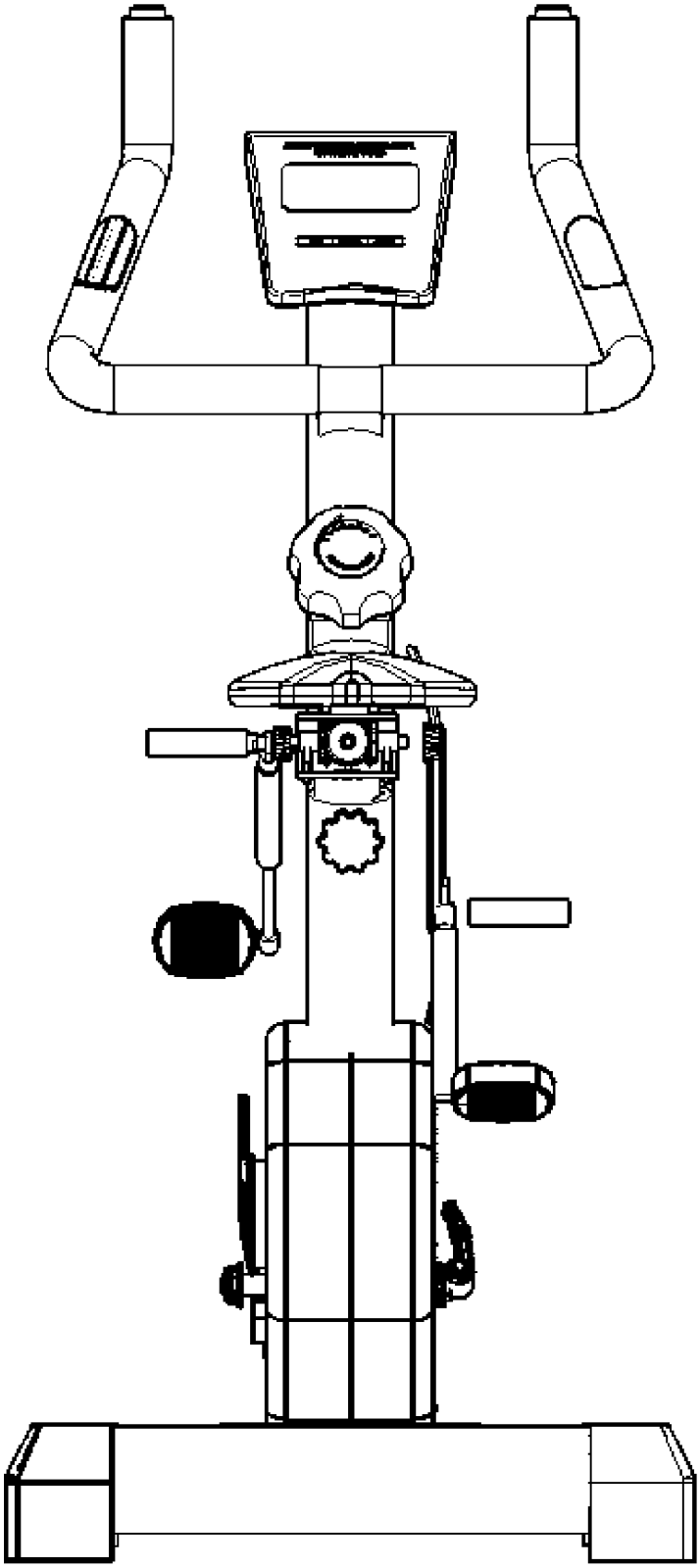
FIG. 19 is a front view of an embodiment of the present invention illustrating a gear device of FIG. 17 attached in a bicycle.

FIGS. 17 and 18 are views illustrating a gear box, in which the axis conversion device is not provided according to another embodiment of the present invention. FIG. 19 is a front view illustrating a state in which the gear box according to another embodiment of the present invention is attached to the indoor bicycle.

Figure 20:
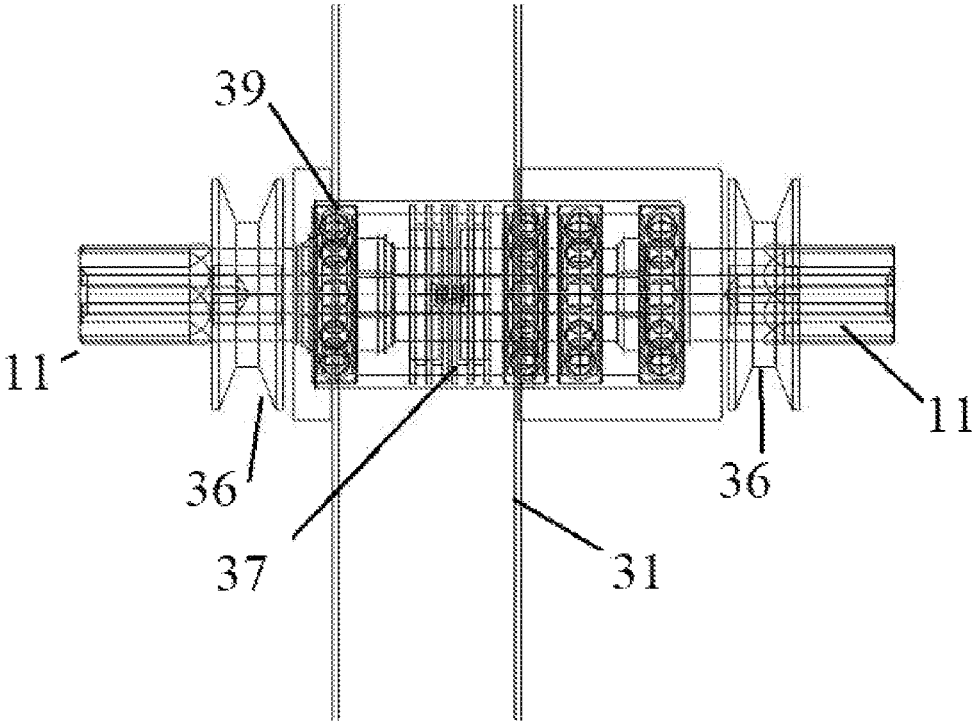
FIG. 20 is a partial view of an embodiment of the present invention, illustrating a gear device using wire and a roller.
Figure 21:
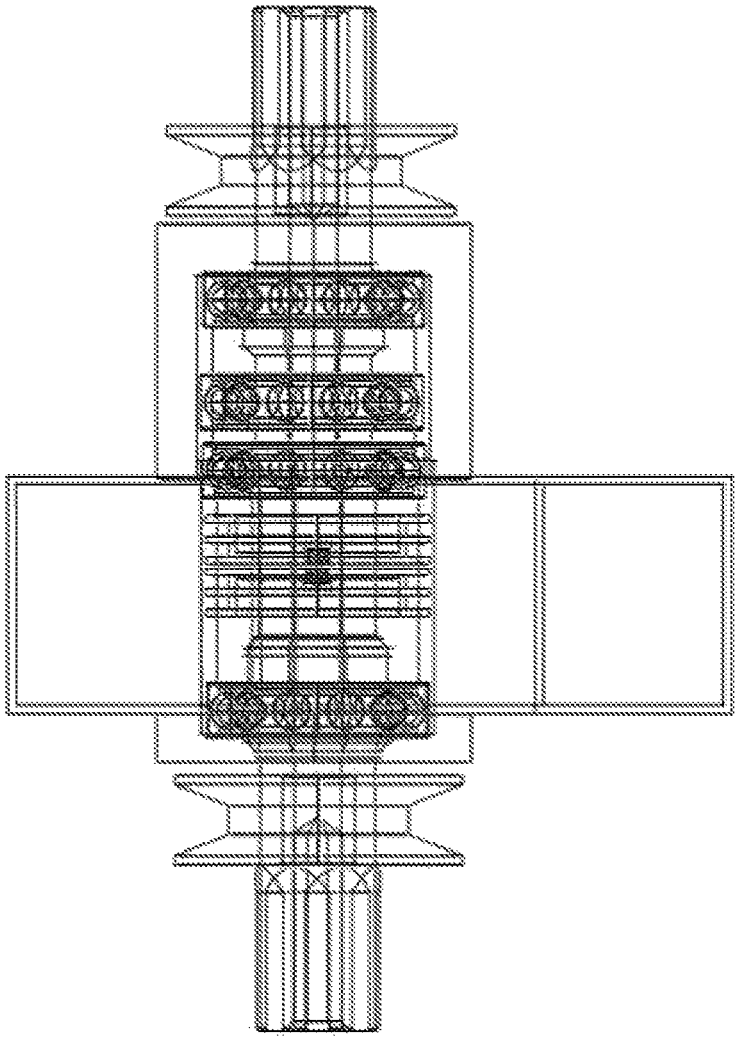
FIG. 21 is a partial view of an embodiment of the present invention, illustrating a gear device using wire and a roller.

FIGS. 20 and 21 are views illustrating the gear box using a wire and a roller according to another embodiment of the present invention.

As illustrated in FIGS. 13 and 14, the gear device includes a pivot axis 11, a horizontal spiral gear or bevel gear 32, a vertical gear or bevel gear 33, a second spiral or bevel gear 34, an arm 35 connected to the bevel gear 32 or 33, a roller 36, a tension belt roller 37, a spur gear or a helical gear 38, a bearing 39, a device 30 for fixing rotation around a y-axis perpendicular to the ground, and a device 31 for fixing the gear device to a vertical frame of another exercise device. Hereinafter, a description on the well-known technology will be omitted. As illustrated in FIGS. 13 to 16 (KR 10-2020-0163490), the axis conversion gear device according to the present invention may include the arm attached onto an x-axis parallel to the ground and simultaneously attached onto the y-axis perpendicular to the ground.

In addition, as illustrated on FIGS. 13 and 14, the axis conversion gear device may include a through which a right x-axis pivot axis passes; a right arm having an upper end portion and a lower end portion through which a y-axis pivot axis passes; and a left penetrating portion through which a left x-axis pivot axis passes, a left arm having an upper end portion and a lower end portion through which the y-axis pivot axis passes, wherein the right x-axis pivot axis passes through the right penetrating portion to be rotatable, and the left x-axis pivot axis passes through the left penetrating portion to be rotatable, wherein, in a case of connecting the gear device to a lower body exercise apparatus, when a user fixes the arm to a position parallel to a ground, the user is able to perform a movement of lowering downward or kicking backward about a hip joint as an axis in a starting position of pulling toward a chest, and, when the user fixes the arm to a position perpendicular to the ground, the user is able to close and open a body while placing the body of the user against an end of the arm.

Figure 22:
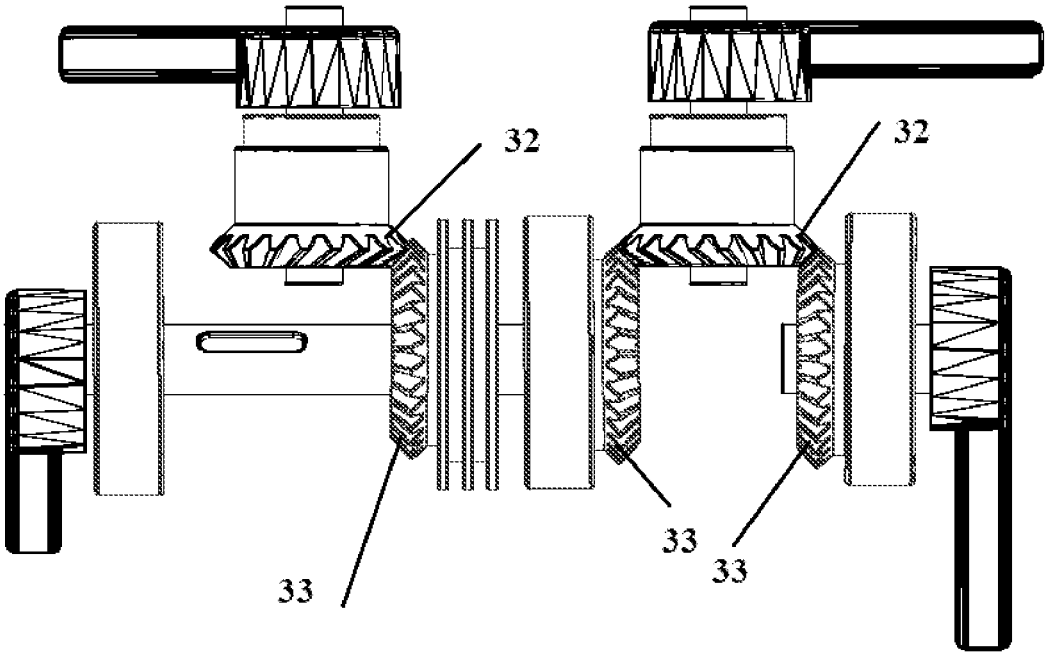
FIG. 22 is a partial view of an embodiment of the present invention illustrating an axis conversion gear device including an arm attached to an x-axis parallel to the ground and simultaneously attached to a y-axis perpendicular to the ground.
Figure 23:
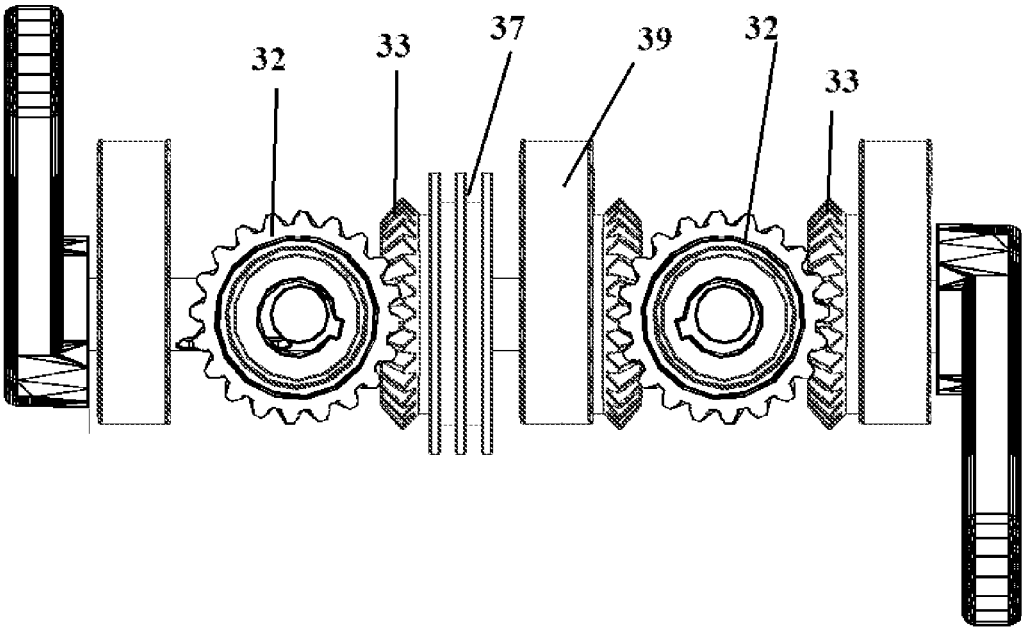
FIG. 23 is a partial view of an embodiment of the present invention illustrating an axis conversion gear device including an arm attached to an x-axis parallel to the ground.
Figure 24:
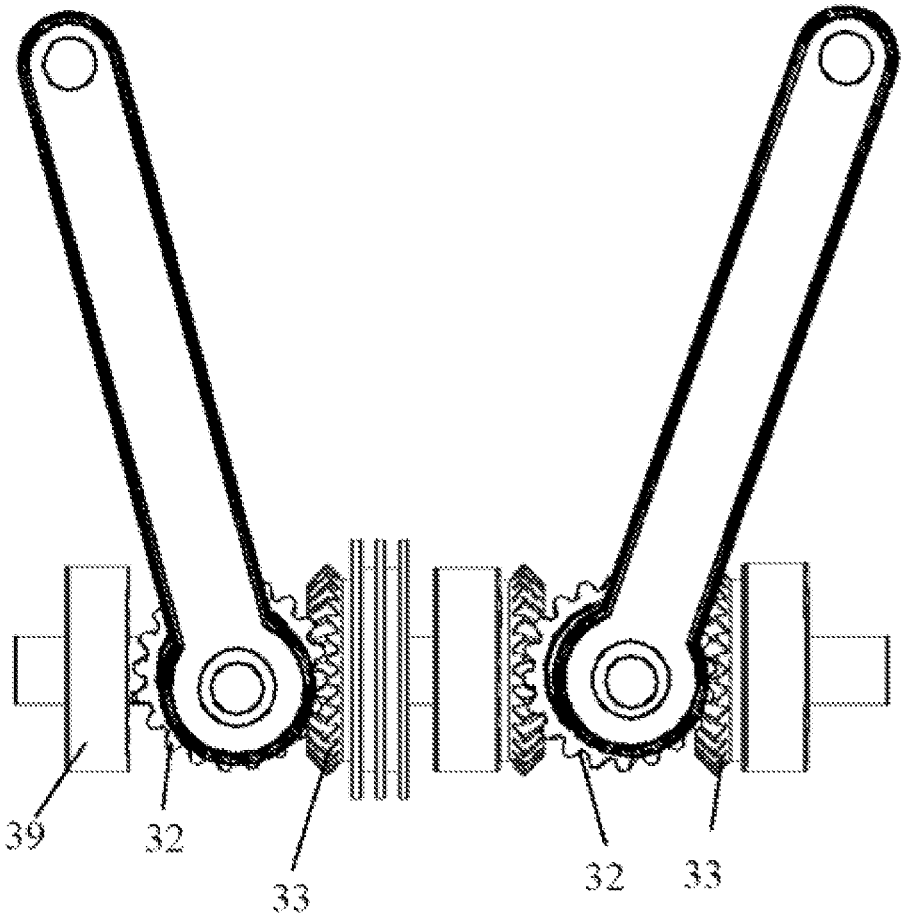
FIG. 24 is a partial view of an embodiment of the present invention illustrating an axis conversion gear device including an arm attached to a y-axis perpendicular to the ground.
Figure 25:
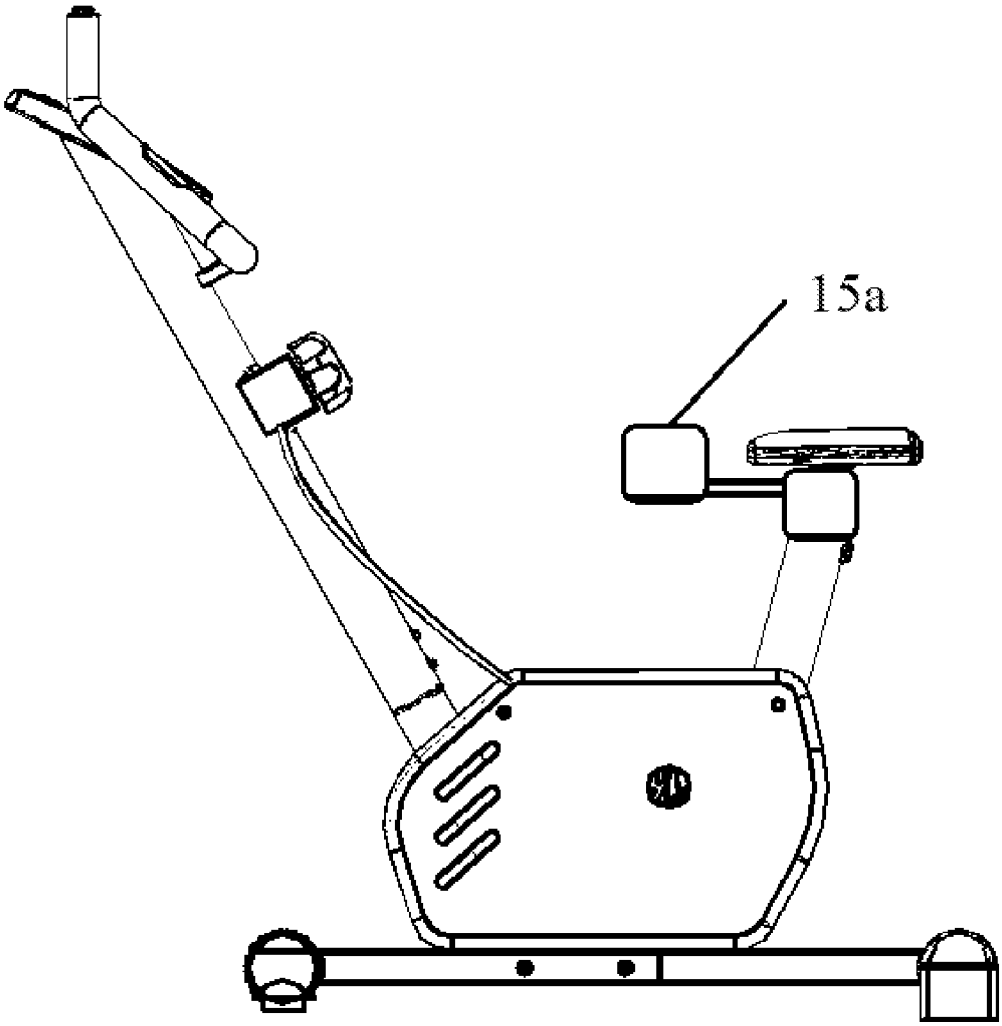
FIG. 25 is a side view illustrating a gear device of an embodiment of the present invention attached to a bicycle.
Figure 28:
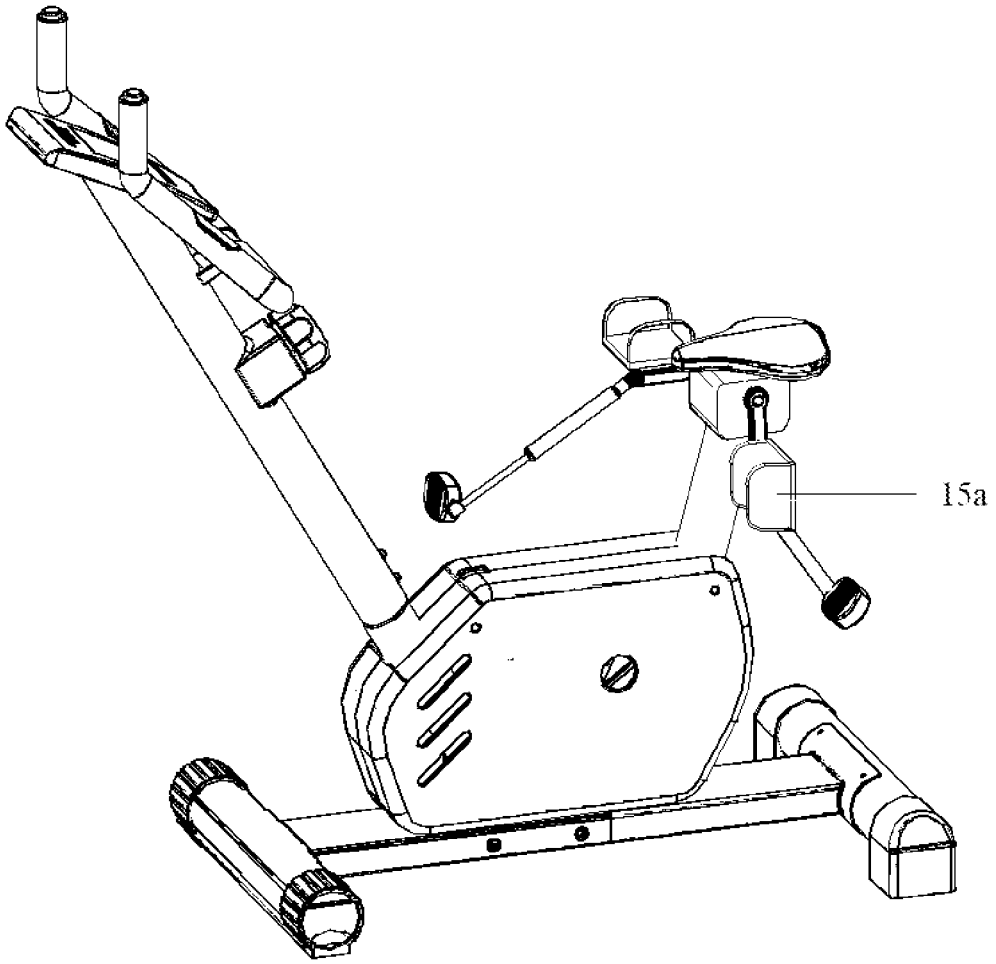
FIG. 28 is a perspective view of an embodiment of the present invention illustrating an axis conversion gear device attached to a bicycle to a leg pad is disposed below the thigh of the user (15*a*)
Figure 29:
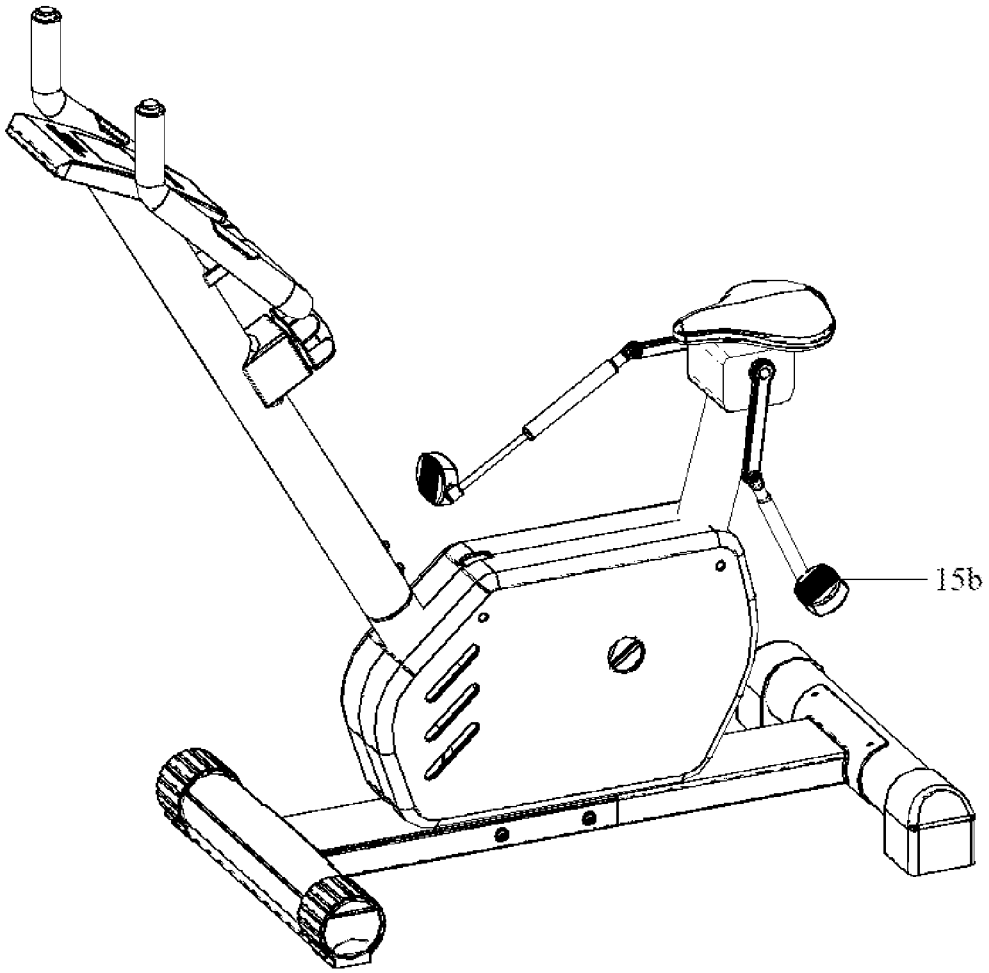
FIG. 29 is a perspective view of an embodiment of the present invention illustrating an axis conversion gear device attached to a bicycle to a leg pad is disposed below the leg of the user (15*b*)
Figure 30:
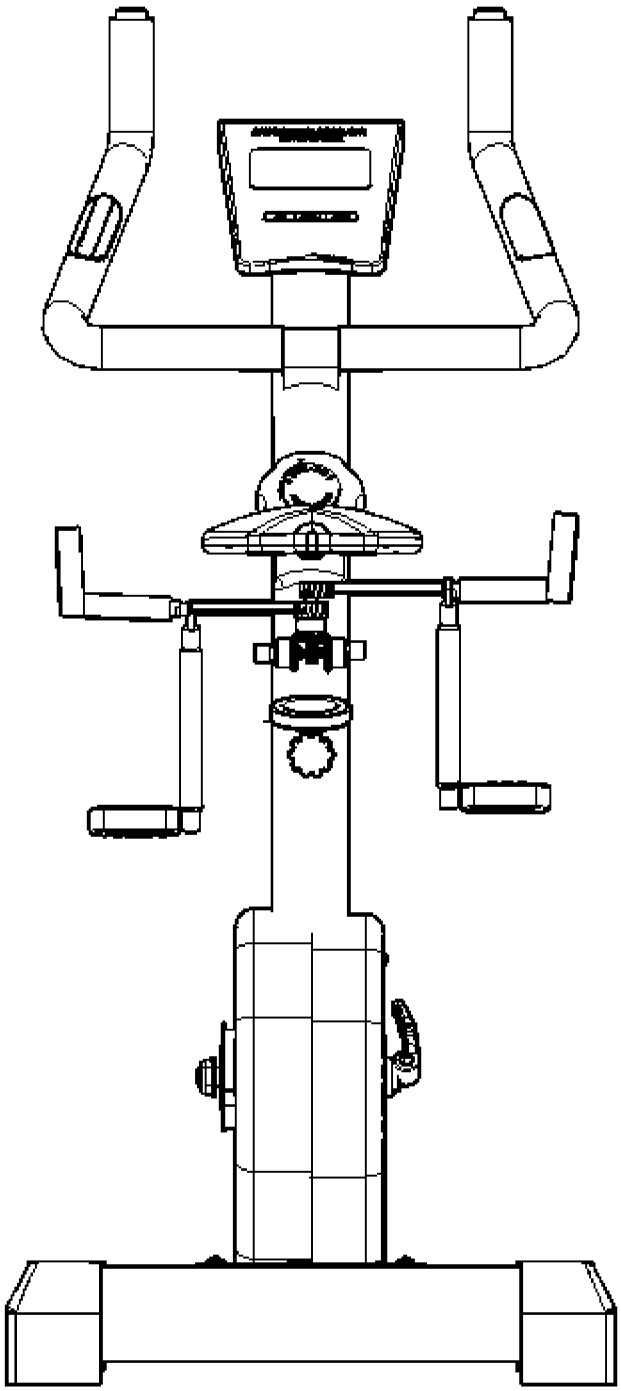
FIG. 30 is a front view of an embodiment of the present invention illustrating an axis conversion gear device attached to a bicycle wherein a leg pad has "L" shape.
Figure 31:
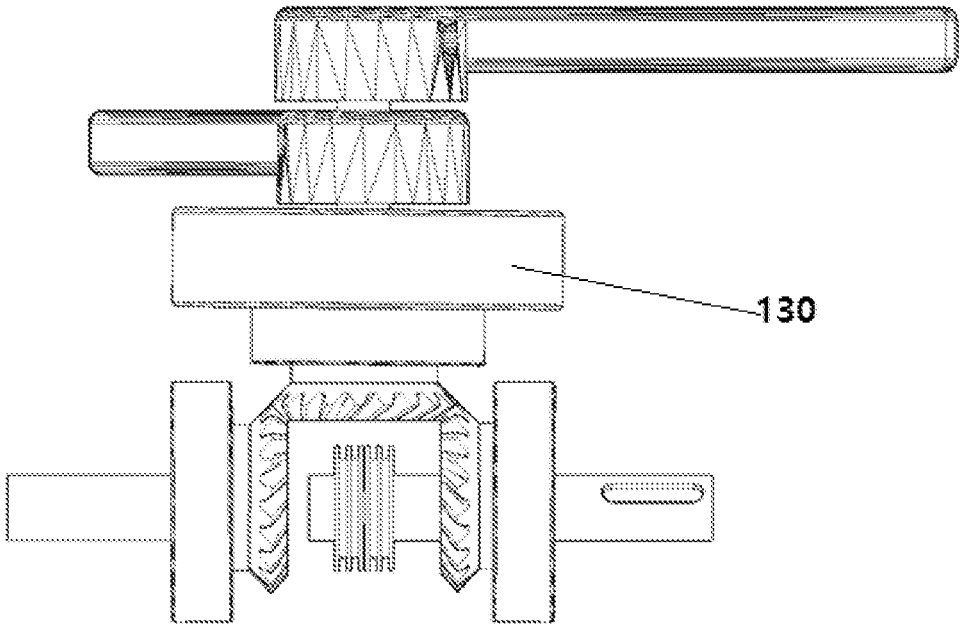
FIG. 31 is a partial view of an embodiment of the present invention illustrating a gear device using ring gear 130 and sun gear.
Figure 32:
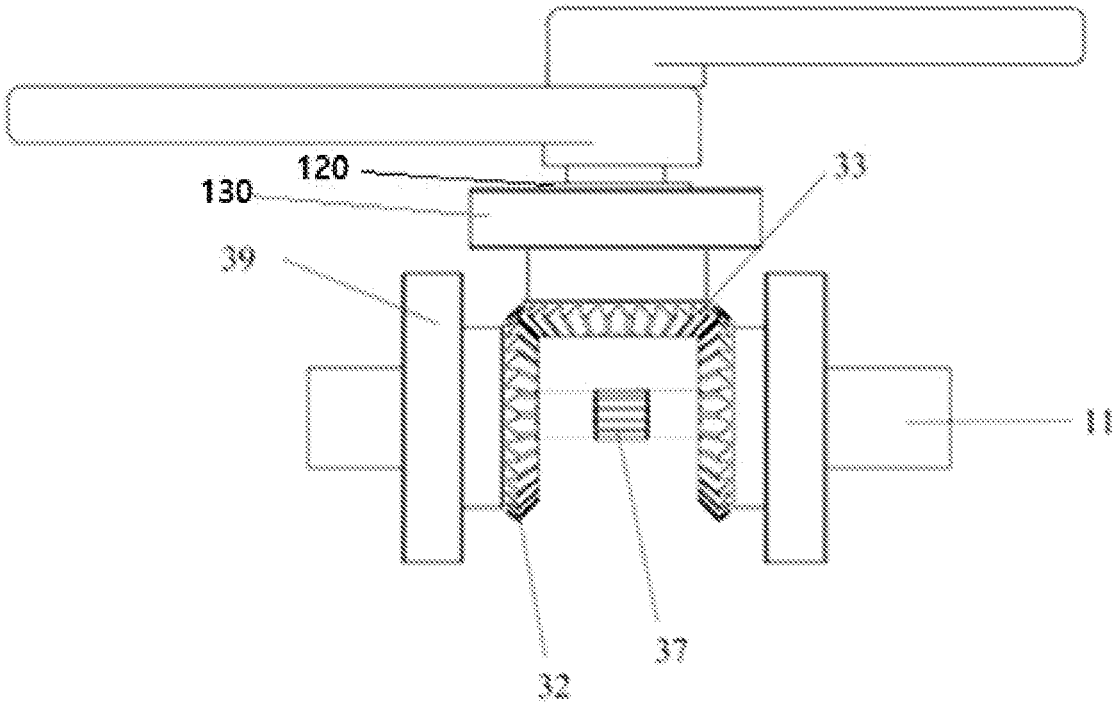
FIG. 32 is a partial view of an embodiment of the present invention illustrating a gear device using ring gear 130 and sun gear 120.
Figure 33:
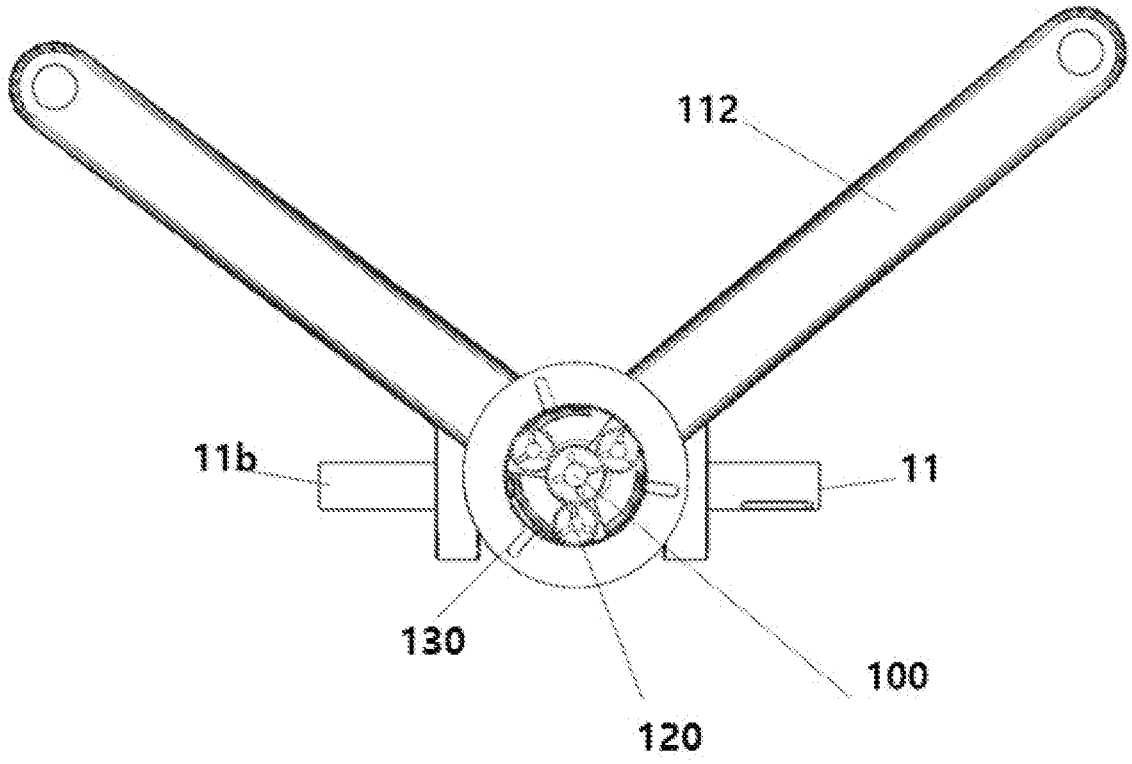
FIG. 33 is a partial view of an embodiment of the present invention illustrating a gear device using ring gear 130 and sun gear 120.
Figure 34:
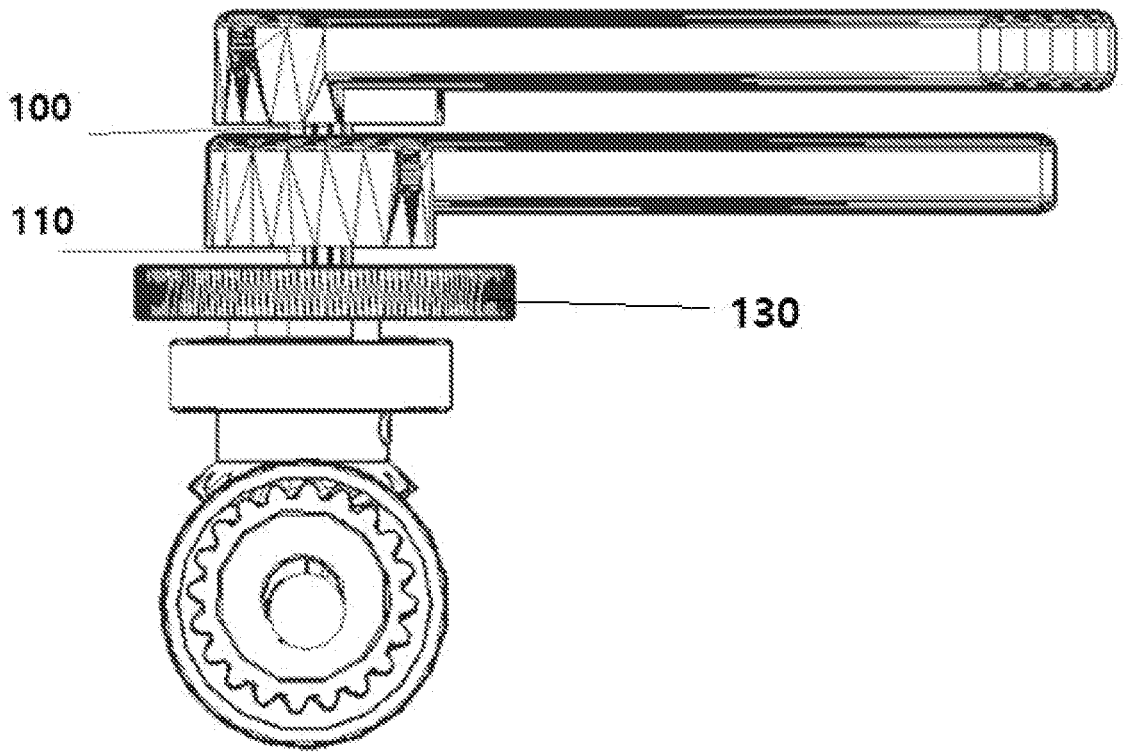
FIG. 34 is a partial view of an embodiment of the present invention illustrating a gear device using ring gear 130 and sun gear.
Figure 35:
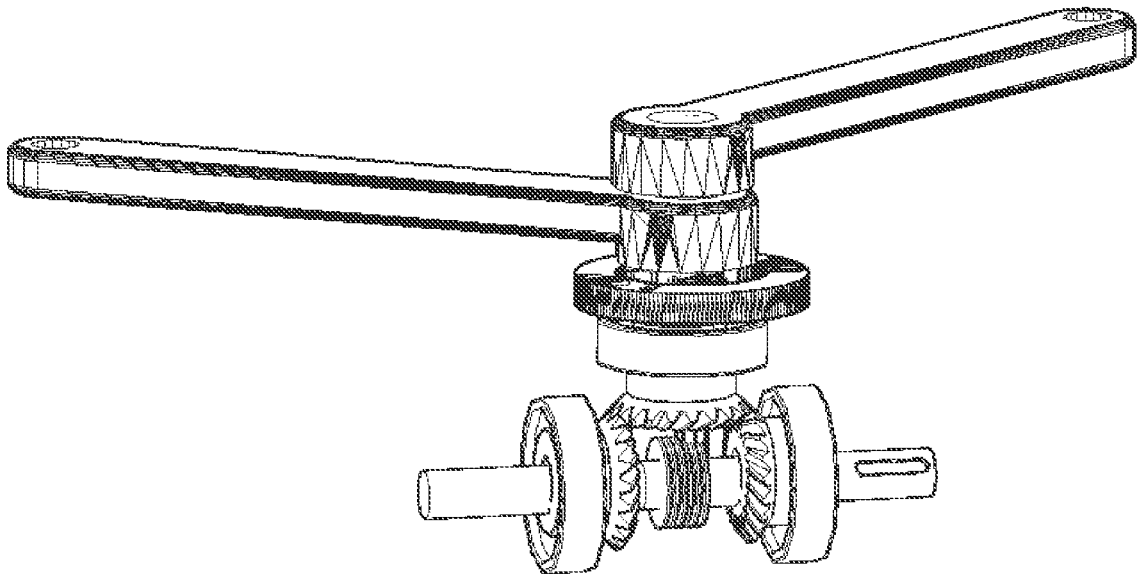
FIG. 35 is a partial view of an embodiment of the present invention illustrating a gear device using ring gear and sun gear.
Figure 36:
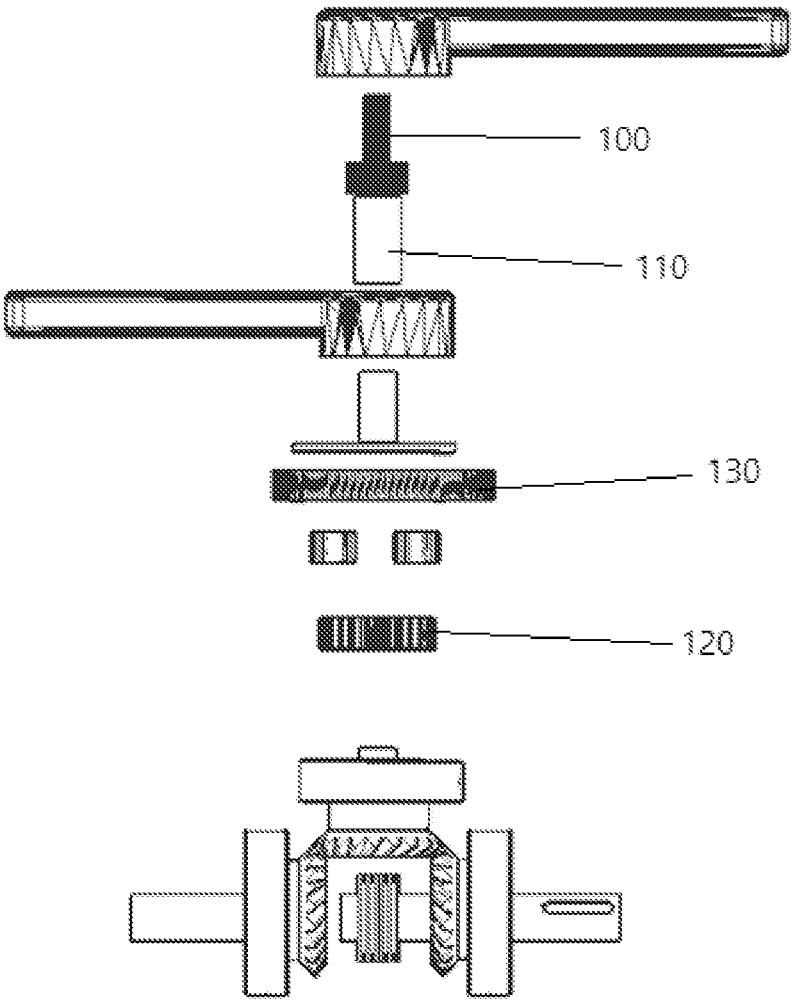

Since the axis conversion gear device according to the present invention may include the arm attached onto the x-axis parallel to the ground as illustrated in FIG. 23 and simultaneously attached onto the y-axis perpendicular to the ground as illustrated in FIG. 22 the user may selectively perform a movement of lowering the legs and moving the legs backward or a movement of putting the legs together. A leg pad may be disposed below the thigh of the user as illustrated in FIGS. 25 and 28 (15*a*) or disposed below of the legs of the user as illustrated in FIG. 29 (15*b*). The leg pad may have a "C"-shape as illustrated in FIGS. 26 and 28 or a "L"-shape as illustrated in FIG. 30.

In addition, as illustrated in FIGS. 22 to 25, in the gear device, a x-axis pivot axis divided into a right side and a left side that are aligned in a coaxial direction and spaced apart from each other; a right vertical bevel gear connected to a left side of the right x-axis pivot axis; a left vertical bevel gear connected to a right side of the left x-axis pivot axis; a right horizontal bevel gear connected to the left vertical bevel gear and the right vertical bevel gear; a y-axis pivot axis connected to an upper end of the right horizontal bevel gear and arranged perpendicular to a x-axis; a second left vertical bevel gear connected to the left x-axis pivot axis; a left horizontal bevel gear connected to the second left vertical bevel gear; and a left y-axis pivot axis connected to an upper end of the left horizontal bevel gear and arranged perpendicular to the x-axis, wherein, when the right x-axis pivot axis rotates clockwise, the left x-axis pivot axis rotates counterclockwise, and when the right y-axis pivot axis rotates clockwise, the left y-axis pivot axis rotates counterclockwise.

Figure 27:
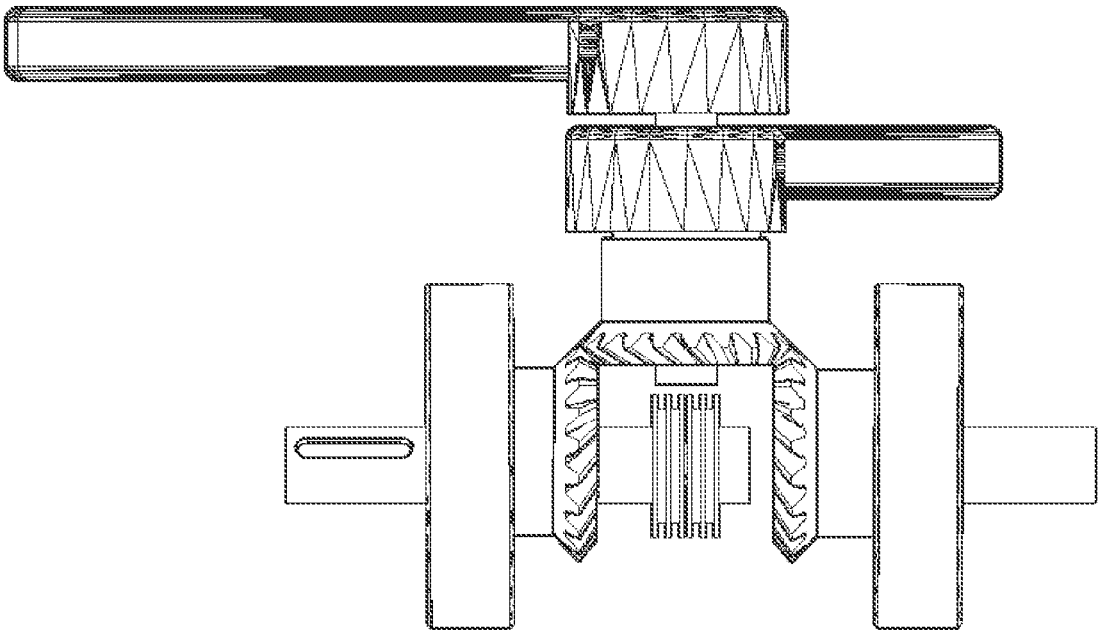
FIG. 27 is a front view illustrating a gear device of an embodiment of the present invention, including a single y-axis that is perpendicular to the ground.

The axis conversion gear device according to the present invention may be attached to a bicycle as illustrated in FIG. 26 and include the single y-axis that is perpendicular to the ground as illustrated in FIG. 27.

In addition, as illustrated in FIGS. 31 to 36 (KR 10-2020-0170941), the exercise device according to the present invention is configured such that as a planetary gear is provided to a y-axis pivot device connected to the arm, when one side arm rotates clockwise, the other side arm rotates counterclockwise.

Specifically, as a sun gear, a planetary gear, and a ring gear are provided, the one side arm connected to the y-axis pivot device and a shaft 100 connected to the one side arm may be connected to the planetary gear or the ring gear 130, and the other side arm and a shaft 110 connected to the other side arm may be connected to the sun gear 120, so that the two arms rotate in opposite directions.

Figure 36:
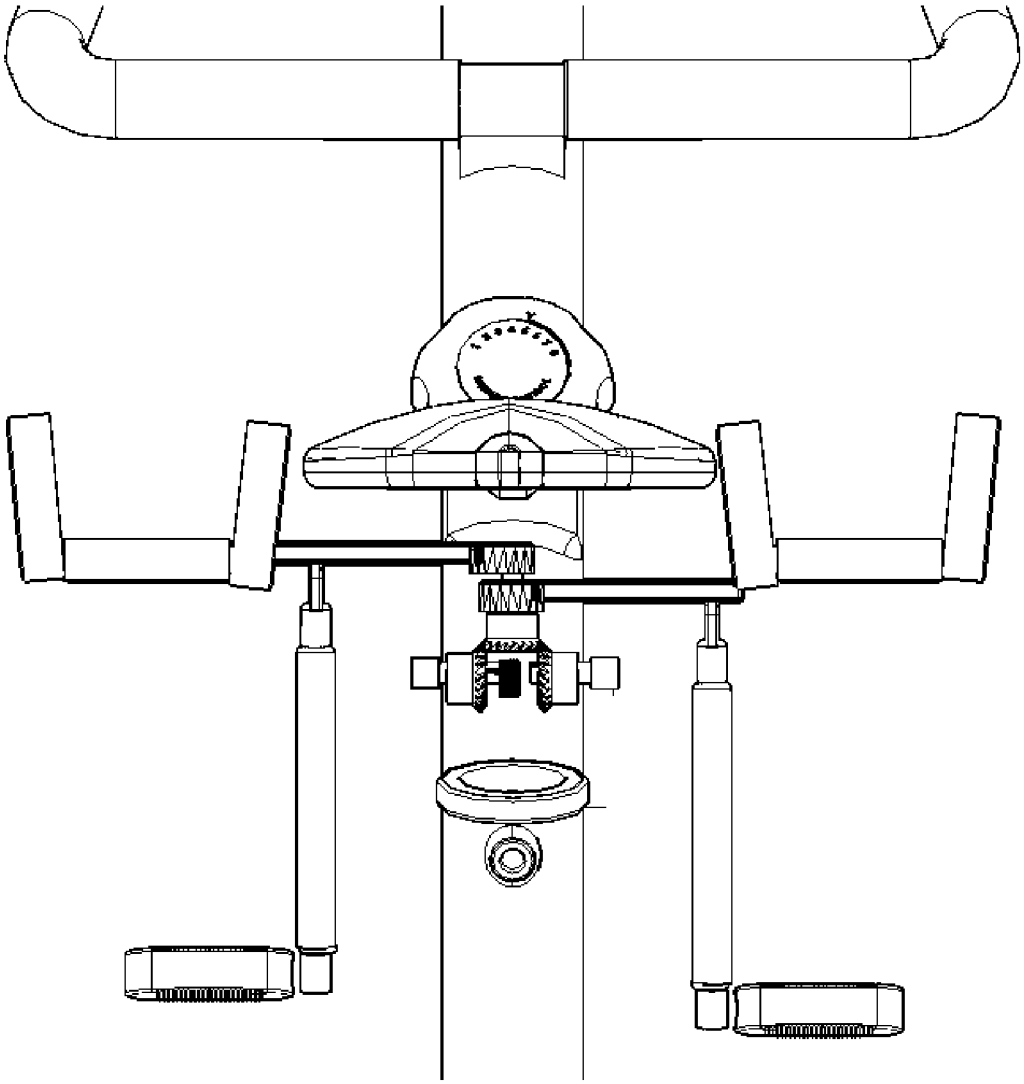
FIG. 36 is an exploded view of an embodiment of the present invention illustrating a gear device using ring gear 130 and sun gear 120.
Figure 37:
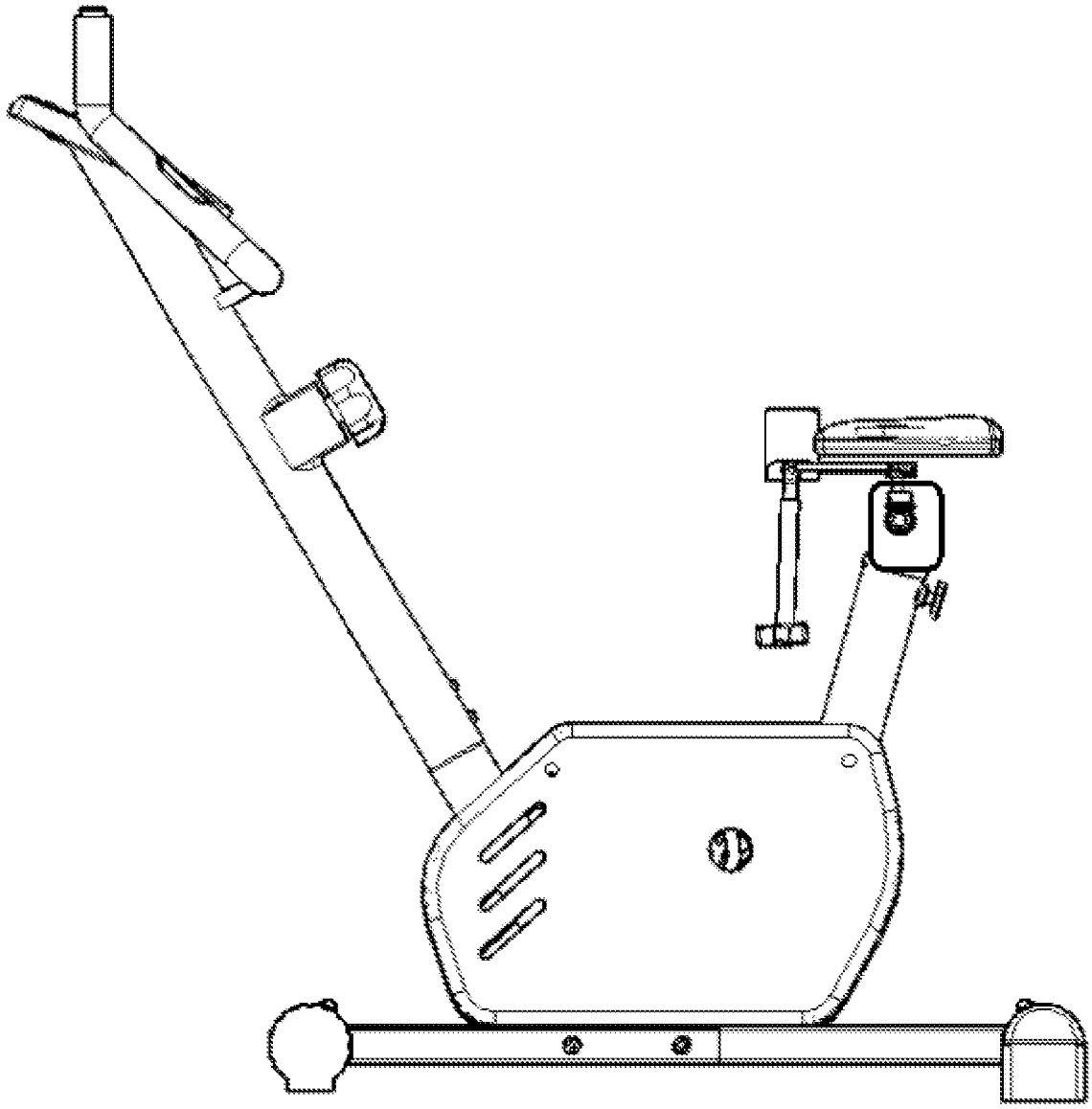
FIG. 37 is a side view illustrating a gear device of an embodiment of the present invention attached to a bicycle.
Figure 38:
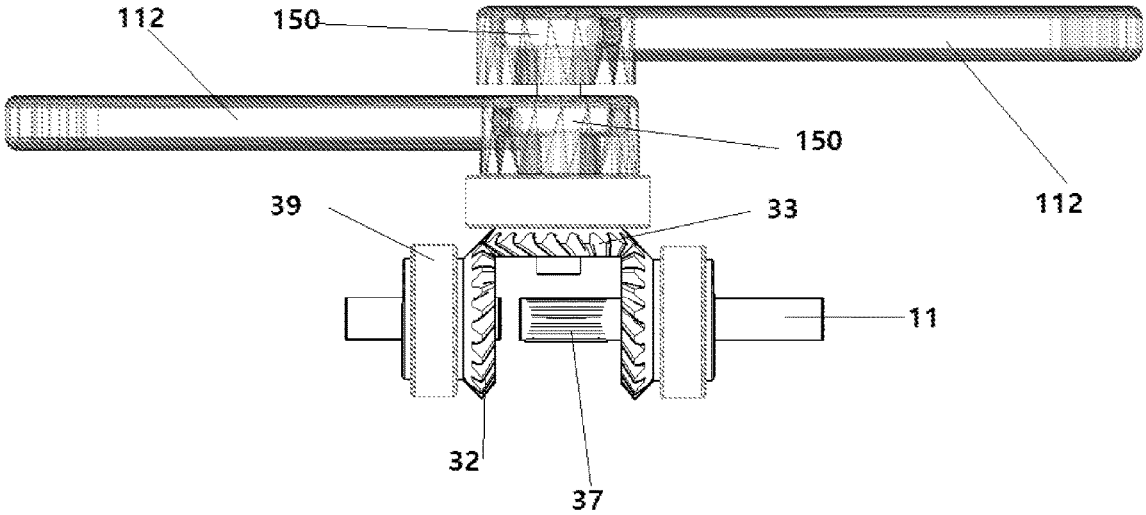
FIG. 38 is a partial view of an embodiment of the present invention illustrating a gear device using a one-way bearing 150.
Figure 39:
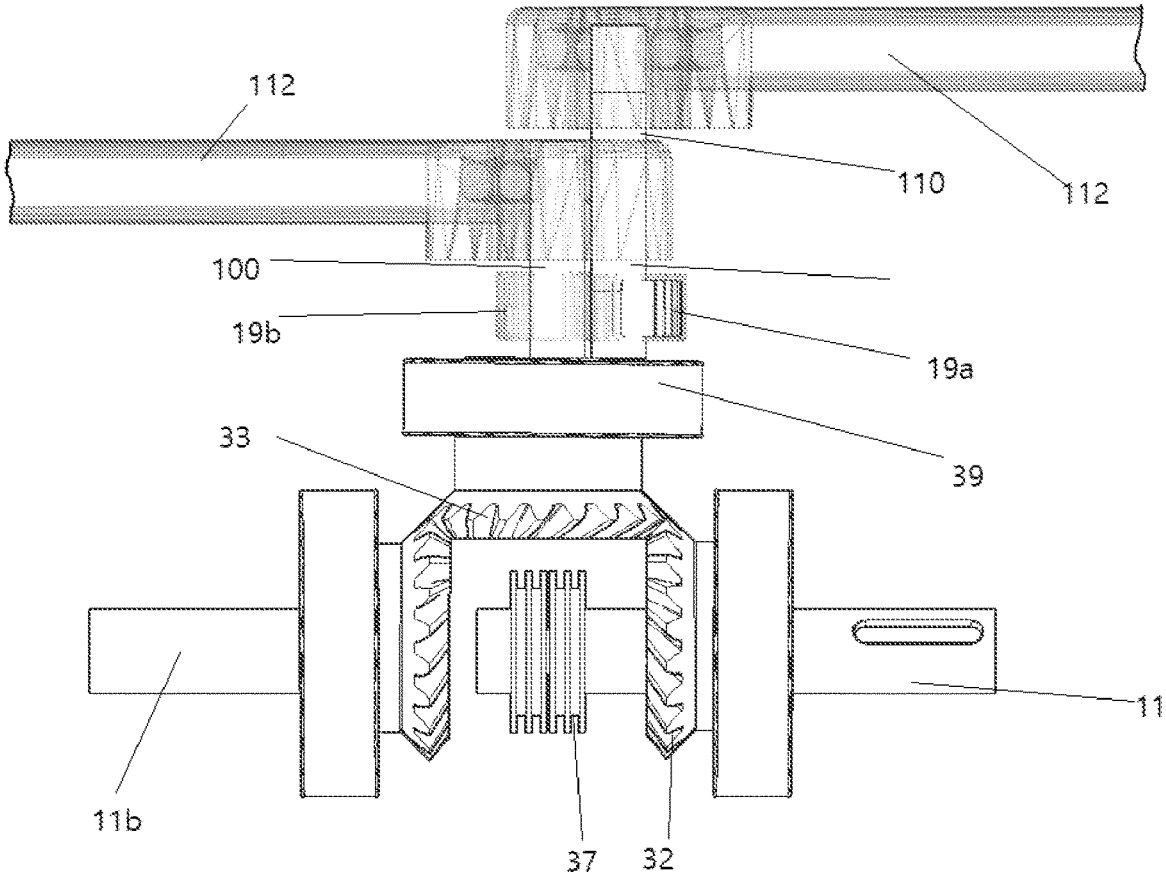
FIG. 39 is a partial view of an embodiment of the present invention illustrating a gear device using spur gear 19*a* and 19*b;*
Figure 40:
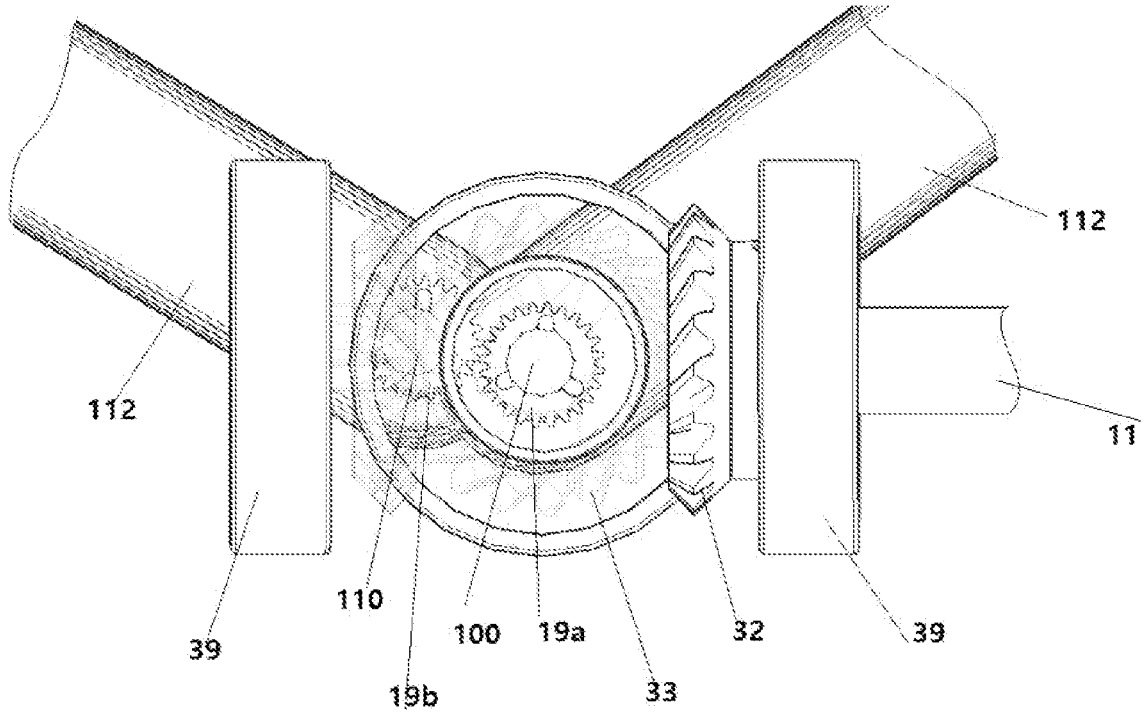
FIG. 40 is a partial view of an embodiment of the present invention illustrating a gear device using spur gear 19*a* and 19*b;*
Figure 41:
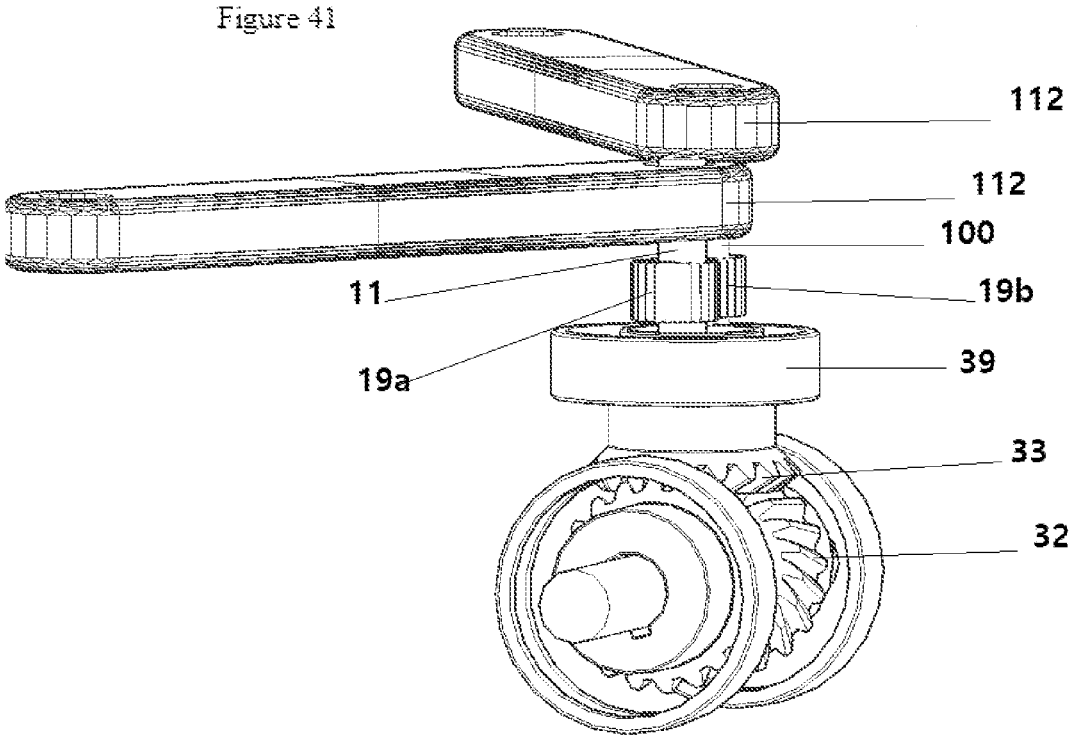
FIG. 41 is a partial view of an embodiment of the present invention illustrating a gear device using spur gear 19*a* and 19*b;*
Figure 42:
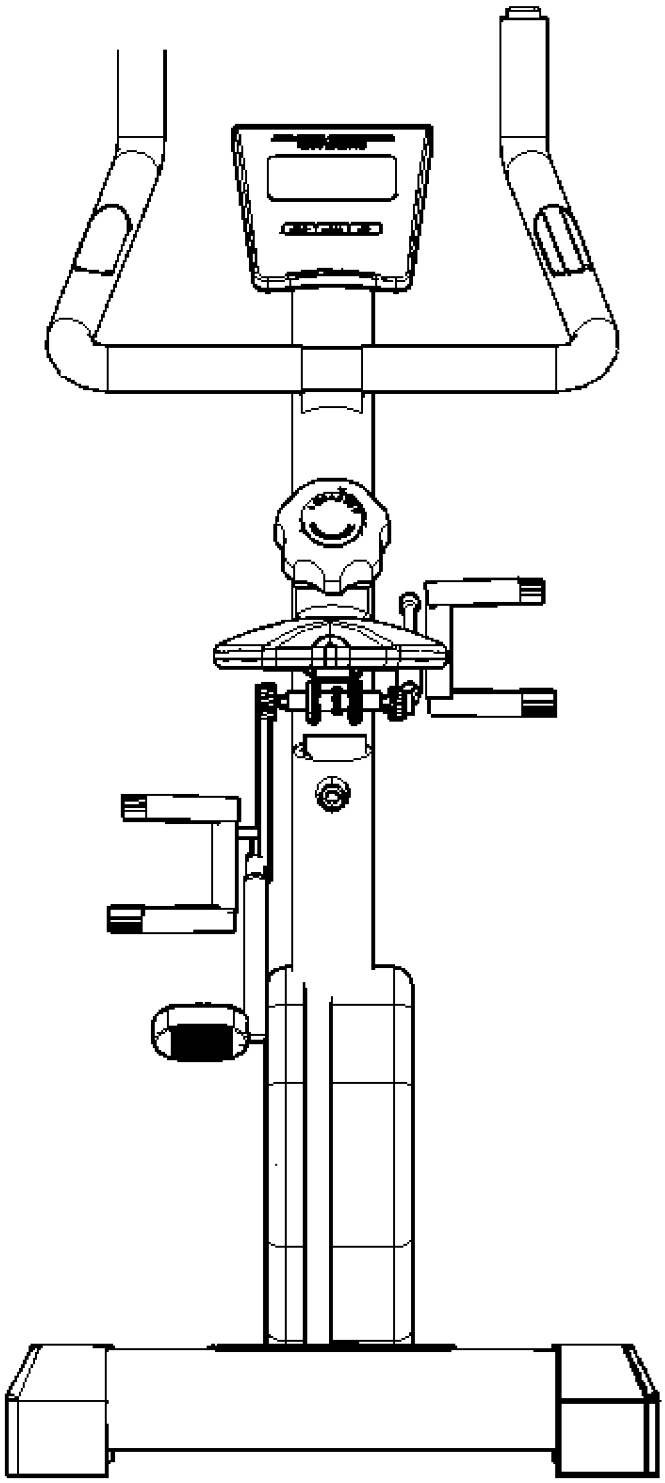
FIG. 42 is a front view illustrating a gear device of an embodiment of the present invention attached to a bicycle.
Figure 43:
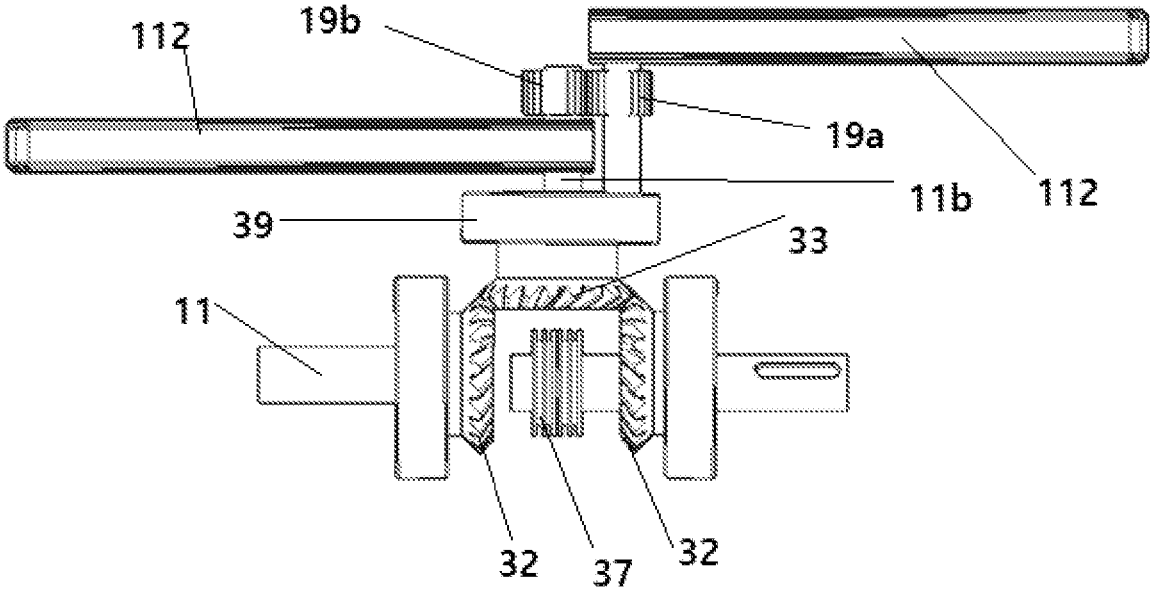
FIG. 43 is a partial view of an embodiment of the present invention illustrating a gear device using spur gear 19*a* and 19*b;*

In addition, as illustrated in FIGS. 36 to 37 (KR 10-2020-0179121), in the gear device, as a one way bearing 150 or a free wheel is provided to the y-axis pivot device or the arm, the arm may idle when the y-axis pivot device rotates in one direction, and the arm may be fixed to the y-axis pivot device and rotate together with the y-axis pivot device when the y-axis pivot device rotates in a direction opposite thereto. Thus, although the two arms are fixed to the y-axis pivot device and rotate in opposite directions, the two arms may not collide with each other. As another example of the gear device illustrated in FIGS. 38 and 39, 42 (KR 10-2021-0002955), as a plurality of shafts and a plurality of arms are provided to the y-axis pivot device, and spur gears 19*a* and 19*b* are provided to the y-axis pivot device or the arm and engaged with each other, when the one side arm connected to the y-axis pivot device rotates clockwise, the other side arm rotates counterclockwise.

In order to resolve an eighth problem of the technical object the exercise device according to the present invention may be configured such that a handle angle adjusting device is provided to an exercise device similar to a total hip machine to perform a complex thigh and hip strengthening exercise by using one exercise device. To this end, the exercise device according to the present invention includes: an arm 10 in which a pivot axis is pivotably disposed at a position parallel to the hip joint of the user; a bar connected to the arm and pivotably disposed below the legs of the user; a handle disposed parallel to left and right sides of the user; the handle angle adjusting device; a weight adjusting device; and an arm start section adjusting device. The handle angle adjusting device adjusts the handle to be disposed at the same position and as the general total hip machine when the user performs the movement of moving the legs backward and putting the legs together or apart, and adjusts the handle to be disposed at a position and at which the handle is not collided with the body of the user when the user performs squat or lunge.

INDUSTRIAL APPLICABILITY

The exercise device according to the present invention may be used for muscle strengthening equipment, an indoor exercise device, a bicycle, an indoor bicycle, a complex exercise device, a band exercise device, and an exercise device gear.

The invention claimed is:

1. An exercise device for exercising legs and hips, comprising:

a front vertical post (1*b*) connected to a front part (1*aa*) of a base frame (1*a*);

a seat (4) connected to a back part (1*ab*) of the base frame (1*a*), wherein, in a plan view, the front vertical post is aligned along a virtual horizontal centerline of the seat;

a guiding rail (2), wherein the guiding rail extends from a top to a bottom in an arc such that, in a side view, the guiding rail is in an arc line shape;

wherein the guiding rail (2) has a pivot point (6*a*) on a frontal plane and is pivotably connected to the front vertical post (1*b*) at the pivot point (6*a*), an arm (3) slidably connected to the guiding rail (2) at a first end of the arm (3), wherein the arm extends horizontally from a left or right side of the guiding rail; and the arm (3) comprises a leg pad (5) supported thereon;

wherein the arm (3) slides alternately and repeatably between clockwise and counterclockwise directions along the arc of the guiding rail with the pivot point located at a center of the arc of the guiding rail, wherein, in a first configuration, the guiding rail is positioned vertically, such that a longitudinal axis of the arm is disposed parallel to the ground; and in a second configuration, the guiding rail is positioned horizontally, such that the longitudinal axis of the arm is disposed perpendicularly to the ground.

* * * * *